US009758997B2

(12) United States Patent
Hagemeyer et al.

(10) Patent No.: US 9,758,997 B2
(45) Date of Patent: Sep. 12, 2017

(54) HIGH SECURITY LOCK FOR DOOR

(71) Applicant: Amesbury Group, Inc., Amesbury, MA (US)

(72) Inventors: Bruce Hagemeyer, Pella, IA (US); Dan Raap, Hartford, SD (US); Gary E. Tagtow, Sioux Falls, SD (US); Tracy Lammers, Sioux Falls, SD (US); Allen Rickenbaugh, Sioux Falls, SD (US)

(73) Assignee: Amesbury Group, Inc., Amesbury, MA (US)

( * ) Notice: Subject to any disclaimer, the term of this patent is extended or adjusted under 35 U.S.C. 154(b) by 399 days.

(21) Appl. No.: 14/135,252

(22) Filed: Dec. 19, 2013

(65) Prior Publication Data

US 2014/0159387 A1 Jun. 12, 2014

Related U.S. Application Data

(63) Continuation of application No. 13/752,594, filed on Jan. 29, 2013, now Pat. No. 8,628,126, which is a (Continued)

(51) Int. Cl.
*E05C 3/06* (2006.01)
*E05C 3/16* (2006.01)

(Continued)

(52) U.S. Cl.
CPC ..... *E05C 3/16* (2013.01); *E05B 63/14* (2013.01); *E05C 3/006* (2013.01); *E05C 9/006* (2013.01);

(Continued)

(58) Field of Classification Search
CPC ..... E05B 63/06; E05B 59/00; E05B 65/0858; E05B 63/14; E05B 63/0056; Y10T 292/06

(Continued)

(56) References Cited

U.S. PATENT DOCUMENTS 419,384 A 1/1890 Towne
651,947 A 6/1900 Johnson (Continued)

FOREIGN PATENT DOCUMENTS

AT 844928 0/1920
DE 1002656 2/1957

(Continued)

OTHER PUBLICATIONS

"Intercity Locks—For All Your Security Needs—Fast", http://www.directlocks.co.uk/locks-multipoint-locks-c-123_96.html, accessed Oct. 27, 2011, original publication date unknown, 3 pgs.

(Continued)

*Primary Examiner* — Mark Williams

(57) ABSTRACT

A high security locking system can be used in a conventional pivot door adapted for use with a latch and deadbolt lock combination. The high security system can be a multi-point lock, received in a recess formed in a locking edge side of a door stile, cooperating with a linkage or other mechanism in a conventional deadbolt/location. The lock can be actuated with a keyed cylinder and thumb turn combination.

19 Claims, 18 Drawing Sheets

Related U.S. Application Data continuation of application No. 13/093,739, filed on Apr. 25, 2011, now Pat. No. 8,382,166, which is a continuation of application No. 12/641,632, filed on Dec. 18, 2009, now Pat. No. 8,348,308.

(60) Provisional application No. 61/139,127, filed on Dec. 19, 2008.

(51) Int. Cl.

| | |
|---|---|
| ***E05B 63/14*** | (2006.01) |
| ***E05C 9/10*** | (2006.01) |
| ***E05C 3/00*** | (2006.01) |
| ***E05C 9/00*** | (2006.01) |
| ***E05C 9/02*** | (2006.01) |
| *E05C 9/18* | (2006.01) |

(52) U.S. Cl.

CPC ..... *E05C 9/025* (2013.01); *E05C 9/026* (2013.01); *E05C 9/10* (2013.01); *E05C 9/1875* (2013.01); *Y10T 29/49826* (2015.01); *Y10T 70/5226* (2015.04); *Y10T 70/5372* (2015.04); *Y10T 292/0848* (2015.04); *Y10T 292/0967* (2015.04); *Y10T 292/102* (2015.04); *Y10T 292/108* (2015.04); *Y10T 292/1015* (2015.04); *Y10T 292/1048* (2015.04); *Y10T 292/1076* (2015.04)

(58) Field of Classification Search

USPC ..... 292/196, 109, 219, 226, 228, 202, 203, 292/210, 304

See application file for complete search history.

(56) References Cited

U.S. PATENT DOCUMENTS 738,280 A 9/1903 Bell et al.
972,769 A 10/1910 Lark
1,094,143 A 4/1914 Hagstrom
1,142,463 A 6/1915 Sheperd
1,251,467 A 1/1918 Blixt et al.
1,277,174 A 8/1918 Bakst
1,359,347 A 11/1920 Fleisher
1,366,909 A 2/1921 Frommer
1,596,992 A 8/1926 Ognowicz
1,646,674 A 10/1927 Angelillo
1,666,654 A 4/1928 Hiering
1,716,113 A 6/1929 Carlson
2,535,947 A 12/1950 Newell
2,739,002 A 3/1956 Johnson
2,862,750 A 12/1958 Minke
3,064,462 A 11/1962 Ng et al.
3,162,472 A 12/1964 Rust
3,250,100 A 5/1966 Cornaro
3,332,182 A 7/1967 Mark
3,413,025 A 11/1968 Sperry
3,437,364 A 4/1969 Walters
RE26,677 E 10/1969 Russell et al.
3,586,360 A 6/1971 Perrotta
3,806,171 A 4/1974 Fernandez
3,899,201 A 8/1975 Paioletti
3,904,229 A 9/1975 Waldo
3,953,061 A 4/1976 Hansen et al.
4,076,289 A 2/1978 Fellows et al.
4,116,479 A 9/1978 Poe
4,132,438 A 1/1979 Guymer
4,236,396 A 12/1980 Surko et al.
4,288,944 A 9/1981 Donovan
4,372,594 A * 2/1983 Gater ..... E05B 63/06 292/1.5
4,476,700 A 10/1984 King
4,500,122 A 2/1985 Douglas
4,593,542 A * 6/1986 Rotondi ..... E05B 63/06 292/1.5
4,602,490 A * 7/1986 Glass ..... E05B 63/06 292/1
4,602,812 A 7/1986 Bourner
4,607,510 A 8/1986 Shanaan et al.
4,639,025 A * 1/1987 Fann ..... E05B 63/06 292/1
4,643,005 A 2/1987 Logas
4,691,543 A 9/1987 Watts
4,754,624 A 7/1988 Fleming et al.
4,768,817 A * 9/1988 Fann ..... E05B 63/06 292/1
4,949,563 A 8/1990 Gerard et al.
4,961,602 A 10/1990 Pettersson
4,962,653 A 10/1990 Kaup
4,962,800 A 10/1990 Owiriwo
4,964,660 A 10/1990 Prevot et al.
4,973,091 A 11/1990 Paulson
5,077,992 A 1/1992 Su
5,092,144 A 3/1992 Fleming et al.
5,118,151 A 6/1992 Nicholas, Jr. et al.
5,125,703 A 6/1992 Clancy et al.
5,171,050 A 12/1992 Mascotte
5,172,944 A 12/1992 Munich et al.
5,197,771 A 3/1993 Kaup et al.
5,265,452 A 11/1993 Dawson et al.
5,290,077 A 3/1994 Fleming
5,364,138 A * 11/1994 Dietrich ..... E05B 63/06 292/1.5
5,373,716 A 12/1994 MacNeil et al.
5,382,060 A 1/1995 O'Toole et al.
5,388,875 A 2/1995 Fleming
5,404,737 A 4/1995 Hotzl
5,456,503 A * 10/1995 Russell, IV ..... E05B 63/06 292/1.5
5,482,334 A 1/1996 Hotzl
5,495,731 A 3/1996 Riznik
5,513,505 A 5/1996 Dancs
5,516,160 A 5/1996 Kajuch
5,524,941 A 6/1996 Fleming
5,524,942 A 6/1996 Fleming
5,609,372 A 3/1997 Ponelle
5,620,216 A 4/1997 Fuller
5,707,090 A 1/1998 Sedley
5,716,154 A 2/1998 Miller et al.
5,722,704 A 3/1998 Chaput et al.
5,782,114 A 7/1998 Zeus et al.
5,791,700 A 8/1998 Biro
5,820,170 A 10/1998 Clancy
5,820,173 A 10/1998 Fuller
5,865,479 A 2/1999 Viney
5,878,606 A 3/1999 Chaput et al.
5,890,753 A 4/1999 Fuller
5,896,763 A 4/1999 Dinkelborg et al.
5,901,989 A 5/1999 Becken et al.
5,906,403 A 5/1999 Bestler et al.
5,915,764 A 6/1999 MacDonald
5,918,916 A * 7/1999 Kajuch ..... E05B 63/202 292/163
5,951,068 A 9/1999 Strong et al.
6,050,115 A 4/2000 Schroter et al.
6,094,869 A 8/2000 Magoon et al.
D433,916 S 11/2000 Frey
6,148,650 A 11/2000 Kibble
6,174,004 B1 1/2001 Picard et al.
6,196,599 B1 3/2001 D'Hooge
6,209,931 B1 4/2001 Von Stoutenborough et al.
6,217,087 B1 4/2001 Fuller
6,250,842 B1 6/2001 Kruger
6,257,030 B1 7/2001 Davis, III et al.
6,264,252 B1 7/2001 Clancy
6,266,981 B1 7/2001 von Resch et al.
6,282,929 B1 9/2001 Eller et al.
6,283,516 B1 9/2001 Viney
6,293,598 B1 9/2001 Rusiana
6,318,769 B1 * 11/2001 Kang ..... E05B 63/06 292/1.5

(56) References Cited

U.S. PATENT DOCUMENTS

| | | | | |
|---|---|---|---|---|
| 6,327,881 | B1 | 12/2001 | Grundler et al. | |
| 6,389,855 | B2 | 5/2002 | Renz et al. | |
| 6,443,506 | B1 | 9/2002 | Su | |
| 6,454,322 | B1 | 9/2002 | Su | |
| 6,502,435 | B2 | 1/2003 | Watts et al. | |
| 6,516,641 | B1 | 2/2003 | Segawa | |
| 6,637,784 | B1 | 10/2003 | Hauber et al. | |
| 6,672,632 | B1 | 1/2004 | Speed et al. | |
| 6,688,656 | B1 | 2/2004 | Becken | |
| 6,733,051 | B1 | 5/2004 | Cowper | |
| 6,776,441 | B2 | 8/2004 | Liu | |
| 6,810,699 | B2 | 11/2004 | Nagy | |
| 6,871,451 | B2 | 3/2005 | Harger et al. | |
| 6,935,662 | B1 | 8/2005 | Hauber et al. | |
| 6,971,686 | B2 | 12/2005 | Becken | |
| 6,994,383 | B2 | 2/2006 | Morris | |
| 7,025,394 | B1 | 4/2006 | Hunt | |
| 7,083,206 | B1 | 8/2006 | Johnson | |
| 7,155,946 | B2 | 1/2007 | Lee et al. | |
| 7,207,199 | B2 | 4/2007 | Smith et al. | |
| 7,249,791 | B2 | 7/2007 | Johnson | |
| 7,261,330 | B1 | 8/2007 | Hauber | |
| 7,404,306 | B2 | 7/2008 | Walls et al. | |
| 7,418,845 | B2 | 9/2008 | Timothy | |
| 7,513,540 | B2 | 4/2009 | Hagemeyer et al. | |
| 7,634,928 | B2 | 12/2009 | Hunt | |
| 7,677,067 | B2 | 3/2010 | Riznik et al. | |
| 7,707,862 | B2 | 5/2010 | Walls et al. | |
| 7,726,705 | B2 | 6/2010 | Kim | |
| 7,735,882 | B2 | 6/2010 | Abdollahzadeh et al. | |
| 7,856,856 | B2 | 12/2010 | Shvartz | |
| 7,878,034 | B2 | 2/2011 | Alber et al. | |
| 8,182,002 | B2 | 5/2012 | Fleming | |
| 8,348,308 | B2 | 1/2013 | Hagemeyer et al. | |
| 8,376,414 | B2 | 2/2013 | Nakanishi et al. | |
| 8,382,166 | B2 | 2/2013 | Hagemeyer et al. | |
| 8,398,126 | B2 | 3/2013 | Nakanishi et al. | |
| 8,628,126 | B2 | 1/2014 | Hagemeyer et al. | |
| 8,840,153 | B2 | 9/2014 | Juha | |
| 8,850,744 | B2 * | 10/2014 | Bauman | E05C 9/1841 292/32 |
| 2002/0104339 | A1 * | 8/2002 | Saner | E05C 9/1841 70/108 |
| 2003/0159478 | A1 | 8/2003 | Nagy | |
| 2004/0004360 | A1 * | 1/2004 | Huang | E05B 63/06 292/337 |
| 2004/0107746 | A1 | 6/2004 | Chang | |
| 2004/0239121 | A1 | 12/2004 | Morris | |
| 2005/0103066 | A1 | 5/2005 | Botha et al. | |
| 2005/0144848 | A1 | 7/2005 | Harger et al. | |
| 2005/0229657 | A1 | 10/2005 | Johansson | |
| 2007/0068205 | A1 | 3/2007 | Timothy | |
| 2007/0080541 | A1 | 4/2007 | Fleming | |
| 2007/0113603 | A1 | 5/2007 | Polster | |
| 2007/0170725 | A1 | 7/2007 | Speyer et al. | |
| 2008/0087052 | A1 | 4/2008 | Abdollahzadeh et al. | |
| 2008/0092606 | A1 | 4/2008 | Meekma | |
| 2008/0141740 | A1 | 6/2008 | Shvartz | |
| 2008/0150300 | A1 | 6/2008 | Harger et al. | |
| 2008/0156048 | A1 | 7/2008 | Topfer | |
| 2008/0156049 | A1 | 7/2008 | Topfer | |
| 2008/0178530 | A1 | 7/2008 | Ellerton et al. | |
| 2008/0179893 | A1 | 7/2008 | Johnson | |
| 2008/0184749 | A1 | 8/2008 | Alber et al. | |
| 2009/0064737 | A1 * | 3/2009 | Fan | E05B 63/06 70/169 |
| 2009/0078011 | A1 | 3/2009 | Avni | |
| 2010/0107707 | A1 * | 5/2010 | Viviano | E05B 63/06 70/124 |
| 2010/0154490 | A1 * | 6/2010 | Hagemeyer | E05B 63/14 70/107 |
| 2010/0213724 | A1 | 8/2010 | Uyeda | |
| 2010/0236302 | A1 | 9/2010 | Uyeda | |
| 2010/0327610 | A1 * | 12/2010 | Nakanishi | E05B 63/185 292/162 |
| 2011/0289987 | A1 | 12/2011 | Chiou et al. | |
| 2012/0146346 | A1 | 6/2012 | Hagemeyer et al. | |
| 2012/0306220 | A1 | 12/2012 | Hagemeyer et al. | |
| 2013/0019643 | A1 | 1/2013 | Tagtow et al. | |
| 2013/0152647 | A1 | 6/2013 | Terei et al. | |
| 2013/0234449 | A1 | 9/2013 | Dery et al. | |
| 2014/0060127 | A1 | 3/2014 | Hemmingsen et al. | |
| 2014/0125068 | A1 | 5/2014 | Hagemeyer et al. | |
| 2016/0108650 | A1 | 4/2016 | Hagemeyer | |

FOREIGN PATENT DOCUMENTS

| | | | |
|---|---|---|---|
| DE | 1584112 | | 9/1969 |
| DE | 2639065 | | 3/1977 |
| DE | 3032086 | | 3/1982 |
| DE | 3836693 | | 5/1990 |
| DE | 9011216 | | 10/1990 |
| DE | 4224909 | | 2/1993 |
| DE | 29807860 | | 8/1998 |
| DE | 10253240 | | 5/2004 |
| DE | 202012002743 | U1 | 4/2012 |
| DE | 202013000920 | U1 | 4/2013 |
| DE | 202013000921 | U1 | 4/2013 |
| DE | 202013001328 | U1 | 5/2013 |
| EP | 0007397 | A1 | 2/1980 |
| EP | 0231042 | A2 | 8/1987 |
| EP | 341173 | | 11/1989 |
| EP | 359284 | | 3/1990 |
| EP | 661409 | | 7/1995 |
| EP | 792987 | | 9/1997 |
| EP | 1106761 | | 6/2001 |
| EP | 1867817 | | 12/2007 |
| EP | 2128362 | | 12/2009 |
| EP | 2273046 | A2 | 1/2011 |
| EP | 2339099 | A1 | 6/2011 |
| EP | 2581531 | A1 | 4/2013 |
| EP | 2584123 | A1 | 4/2013 |
| EP | 2584124 | A2 | 4/2013 |
| FR | 21883 | E | 4/1921 |
| FR | 1142316 | | 3/1957 |
| FR | 1162406 | A | 9/1958 |
| FR | 1201087 | | 12/1959 |
| FR | 2339723 | | 9/1977 |
| FR | 2342390 | | 9/1977 |
| FR | 2344695 | | 10/1977 |
| FR | 2502673 | | 10/1982 |
| GB | 226170 | | 4/1925 |
| GB | 264373 | A | 1/1927 |
| GB | 612094 | A | 11/1948 |
| GB | 1498849 | | 1/1978 |
| GB | 1575900 | | 10/1980 |
| GB | 2051214 | | 1/1981 |
| GB | 2076879 | | 12/1981 |
| GB | 2115055 | A | 9/1983 |
| GB | 2122244 | | 1/1984 |
| GB | 2126644 | | 3/1984 |
| GB | 2134170 | | 8/1984 |
| GB | 2136045 | | 9/1984 |
| GB | 2168747 | | 6/1986 |
| GB | 2196375 | | 4/1988 |
| GB | 2212849 | | 8/1989 |
| GB | 2225052 | | 5/1990 |
| GB | 2230294 | | 10/1990 |
| GB | 2242702 | | 10/1991 |
| GB | 2244512 | | 12/1991 |
| GB | 2265935 | | 10/1993 |
| GB | 2270343 | | 3/1994 |
| GB | 2280474 | | 2/1995 |
| GB | 2318382 | A | 4/1998 |
| GB | 2364545 | | 1/2002 |
| GB | 2496911 | A | 5/2013 |
| IT | 614960 | | 1/1961 |
| SE | 309372 | | 3/1969 |
| WO | 96/25576 | | 8/1996 |

(56) References Cited

FOREIGN PATENT DOCUMENTS

| | | |
|---|---|---|
| WO | 02/33202 | 4/2002 |
| WO | 2007/104499 | 9/2007 |

OTHER PUBLICATIONS

"Intercity Locks—For All Your Security Needs—Fast", http://www.directlocks.co.uk/locks-multipoint-locks-c-123_96.html?page=2&sort=2A, accessed Oct. 27, 2011, original publication date unknown, 3 pgs.
"Intercity Locks—For All Your Security Needs—Fast", http://www.directlocks.co.uk/locks-multipoint-locks-c-123_96.html?page=3&sort=2A, accessed Oct. 27, 2011, original publication date unknown, 3 pgs.
"LocksOnline.co.uk: Premier Supplier of Security Products", http://www.locksonline.co.uk/acatalog/Maco_multipoint_lock_2_cams_2_shootbolt_attachment.html, accessed Oct. 27, 2011, original publication date unknown, 5 pgs.
"LocksOnline.co.uk: Premier Supplier of Security Products", http://www.locksonline.co.uk/acatalog/upvc_Locks.html, accessed Oct. 27, 2011, original publication date unknown, 6 pgs.
"uPVC Window Hardware and uPVC Door Hardware online", http://www.upvc-hardware.co.uk/, accessed Oct. 27, 2011, original publication date unknown, 2 pgs.
PCT International Search Report and Written Opinion in Application PCT/US2009/069007, mailed Dec. 19, 2008, 9 pgs.

* cited by examiner

HIGH SECURITY LOCK FOR DOOR

CROSS-REFERENCE TO RELATED APPLICATIONS

This application is a continuation application of U.S. patent application Ser. No. 13/752,594, filed on Jan. 29, 2013, now U.S. Pat. No. 8,628,126; which is a continuation of U.S. patent application Ser. No. 13/093,739 filed on Apr. 25, 2011, now U.S. Pat. No. 8,382,166; which is a continuation of U.S. patent application Ser. No. 12/641,632 filed on Dec. 18, 2009, now U.S. Pat. No. 8,348,308; which claims priority to and the benefit of U.S. Provisional Application Ser. No. 61/139,127, filed Dec. 19, 2008, the disclosures of which are hereby incorporated by reference herein in their entireties.

FIELD OF THE INVENTION

This invention relates generally to high security door locks and, more specifically, to multi-point door locks that can be installed in doors and that utilize standard lock cylinders and hardware.

BACKGROUND

Multi-point door locks typically include two or more locking elements that move in unison from a retracted position within a door stile to an extended position to lock the door to a door frame. In general, multi-point locks are installed in the locking edge face of sliding doors (such as patio doors) or pivoting doors (such as double French doors) and form a robust locking mechanism that improves structural performance and security.

Multi-point locks for pivoting doors generally include a single housing that includes the various components, such as gears, levers, springs and other elements. The locking housing also includes one or more locking members (in the case of a true "multi-point" lock, two or more locking members are present) that rotate from a retracted position within the housing to an extended, locked position outside of the housing. When extended, the locking members engage with one or more keepers on a door frame or mating door. The locking members alternatively may be contained in housings remote from the main housing, above and below the main housing located near the center of a door. In some cases, multi-point locks may utilize, alternatively or additionally, linear locking members, for example pins or deadbolts, that extend linearly into the top head and bottom sill or threshold of the door frame.

Due to the complexity of the locking mechanisms, multi-point locks for pivoting doors typically are actuated by rotating a cantilevered handle in an upward direction to extend the locking elements and a downward direction to retract them. A thumb turn or lock cylinder integral with the main housing can be rotated to extend the deadbolt and prevent retraction of the locking elements. The integral actuation components prevent the multi-point locks from being used with conventional latch and deadbolt systems. While conventional spring latch and deadbolt combinations can be used with pivoting doors, they can only provide a moderate level of security as compared to multi-point locks. Pivoting doors that are configured for latch and deadbolt systems typically can not accommodate multi-point locks due to the relative size and configuration of the multi-point locks. In fact, multi-point locks typically are configured such that only specific handles or actuators may be used therewith. Accordingly, there is a need to provide an enhanced security multi-point lock system for use with conventional deadbolt lock cylinders and door latch hardware utilized in pivoting doors. There is also a need to provide a universal multi-point lock system that may be used with deadbolt lock cylinders and actuators manufactured by a variety of manufacturers.

SUMMARY OF THE INVENTION

In one aspect, the invention relates to a door lock including a drive bar adapted for movement from a first position to a second position, a locking member connected to the drive bar, the locking member adapted for movement from a first position to a second position upon movement of the drive bar from the first position to the second position, a bar slide adapted for movement from a first position to a second position, upon application of a force to the bar slide, and a transmission for coupling movement of the bar slide with movement of the drive bar. In an embodiment, the drive bar moves substantially vertically, wherein the bar slide moves substantially linearly, and wherein the transmission translates the substantially linear movement of the bar slide to the substantially vertical movement of the drive bar. In another embodiment, the drive bar is oriented substantially orthogonal to the bar slide. In yet another embodiment, the locking member is adapted to move pivotally from a first, retracted position to a second, extended position. In still another embodiment, the bar slide includes a first end defining an opening for connection to an actuator, and a second end pivotally connected to the transmission, wherein, from the first position of the bar slide to the second position of the bar slide, the first end moves in a substantially arcing direction and the second end moves in a substantially linear direction.

In an embodiment of the above aspect, the door lock includes a pivot pin connecting the second end and the transmission, wherein the pivot pin moves in a substantially linear direction from the first position of the bar slide to the second position of the bar slide. In another embodiment, the door lock includes an elongate housing, wherein the drive bar is located substantially within the elongate housing. In yet another embodiment, the door lock includes a cover plate adapted to be secured to the elongate housing. In still another embodiment, the elongate housing includes a U-shaped channel defining at least one aperture. In another embodiment, the locking member extends through the aperture when in the second position.

In an embodiment of the above aspect, the locking member is pivotally connected to the elongate housing. In yet another embodiment, the locking member includes an inner pin and an outer deadbolt element. In still another embodiment, the outer deadbolt element has a leading tapered surface and a trailing tapered surface. In another embodiment, the door lock includes a bar slide housing, wherein the bar slide is located at least partially within the bar slide housing, and wherein the bar slide is adapted for sliding linear movement in the bar slide housing.

In an embodiment of the above aspect, the transmission includes at least one of a bar link, a gear, and a cable. In another embodiment, the locking member includes a plurality of locking members. In yet another embodiment, the drive bar includes a substantially vertical drive bar axis and the bar slide includes a bar slide axis at an angle to the drive bar axis, and wherein the transmission includes a bar link including a bar link axis. In still another embodiment, when the drive bar and the bar slide are in their respective first positions, the bar link axis is substantially parallel to the bar slide axis. In another embodiment, when the drive bar and the bar slide are in their respective second positions, the bar link axis is substantially perpendicular to the bar slide axis. In yet another embodiment, when the drive bar and the bar slide are in their respective second positions, the bar link axis is defined by an angle of less than about 90° from the bar slide axis. In still another embodiment, when the drive bar and the bar slide are in their respective second positions, the bar link axis is substantially parallel to the bar drive axis.

In an embodiment of the above aspect, the door lock further includes an insert housing, wherein the bar slide is located at least partially within the insert housing, and a connection pin coupling the transmission and the bar slide. In an embodiment, the insert housing defines a slot having a first travel portion and a detent, and wherein the connection pin slides along the slot. In another embodiment, the connection pin is located in the detent when the drive bar is in the second position.

In another aspect, the invention relates to a method of installing a lock in a door having an locking edge face and opposing sides defining a bore therethrough, the method including the steps of providing a lock including a drive bar adapted for vertical movement, a locking member connected to the drive bar, a bar slide adapted for movement upon application of a force to the bar slide, and a transmission for coupling movement of the bar slide with the drive bar, and installing the lock in a recess formed in the locking edge face of the door. In an embodiment, the method includes first forming the recess sized to accommodate the lock in the locking edge face of the door. In another embodiment, the recess intersects with the bore. In yet another embodiment, the method includes removing an existing deadbolt from the door. In still another embodiment, the method includes installing at least one of a lock cylinder and a thumb turn in the door, so as to apply the force to the bar slide through the bore.

BRIEF DESCRIPTION OF THE FIGURES

Other features and advantages of the present invention, as well as the invention itself, can be more fully understood from the following description of the various embodiments, when read together with the accompanying drawings, in which.

DETAILED DESCRIPTION

Figure 1:
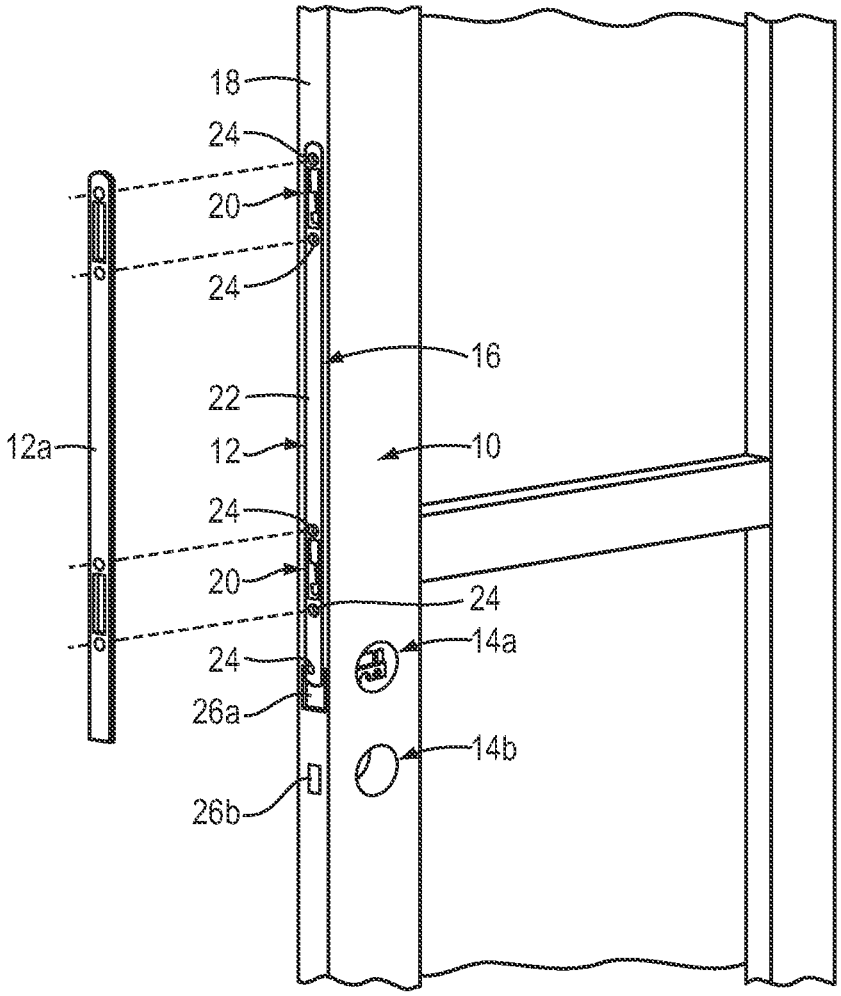
FIG. 1 is a schematic perspective view of a door stile having installed therein a multi-point door lock in accordance with one embodiment of the invention.

FIG. 1 depicts a schematic perspective view of a two-bore door stile 10 having installed therein a multi-point door lock 12 in accordance with one embodiment of the invention. The door stile 10 includes one or more openings or bores 14*a*, 14*b* extending between the opposing sides (i.e., inside and outside) of the door stile 10. Alternatively, these bores may extend only partially though the door stile 10, being defined only by one side thereof. The multi-point lock 12, in the depicted embodiment, is installed in a channel 16 formed in the locking edge side 18 of the door stile 10. Additionally, certain components of the multi-point lock 12 extend at least partially into at least one of the bores. In FIG. 1, the components, described in more detail below, extend into the upper bore 14*a*. In a conventional arrangement, the upper bore 14*a* is adapted to receive a deadbolt activated by a thumb turn, a cylinder lock, or both. The lower bore 14*b* is adapted to receive a spring loaded latch and handle assembly. While FIG. 1 depicts a two bore door stile 10, the multi-point lock described herein may be used on any door or closure, regardless of application or number of bores. For example, the multi-point lock may be used in cabinet, locker, or other doors that lack a second opening for a spring-loaded latch. In such configuration, a pull handle may be used to open and/or close the door.

The multi-point lock 12 includes two spaced locking members 20. A base 22 of a U-shaped channel 40 (described in more detail below in FIG. 2) is recessed into the locking edge side of the door stile 10. A cover plate 12*a* may be secured to the base through the various screw holes 24 to cover the lock 12 for aesthetic purposes. The screw holes 24 can additionally be used with screws to secure the channel 40 to the door stile 10. The cover plate 12*a* may extend beyond a bottom portion of the multi-point lock 12 to cover an upper opening 26*a* in the door stile 10 in which a conventional deadbolt is disposed. Typically, the spring loaded latch and handle assembly may still be utilized with the depicted multi-point lock 12, with the spring loaded latch projecting out of a lower opening 26*b*.

Figure 2:
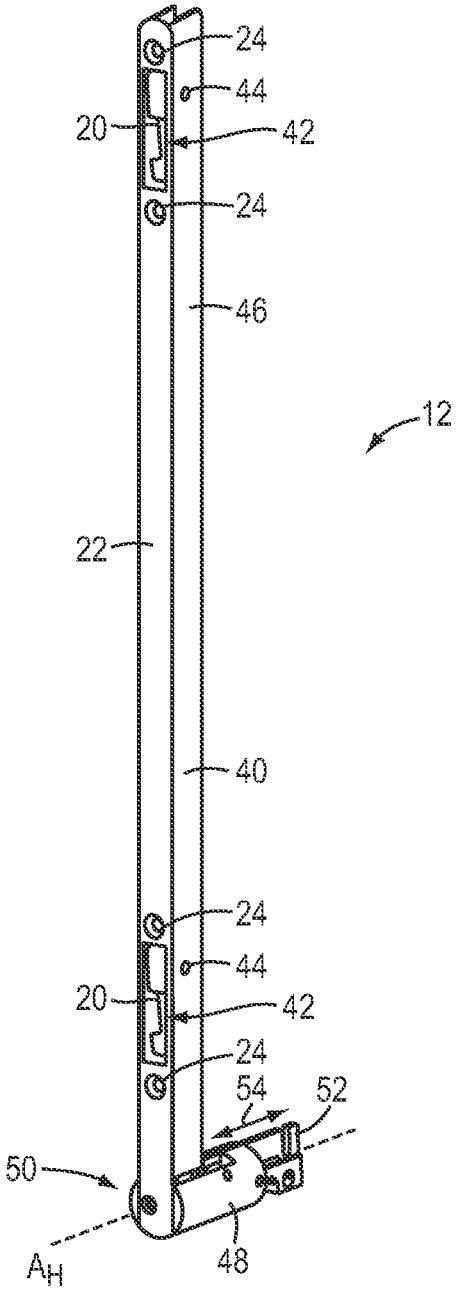
FIG. 2 is a schematic perspective view of the multi-point door lock of FIG. 1.

FIG. 2 depicts the multi-point lock 12 depicted in FIG. 1. As described above, the multi-point lock may include two locking members 20, but in certain embodiments, as few as one or more than two locking members may be utilized.

When in the retracted position, as depicted in FIG. 2, the locking members 20 are retracted within the U-shaped channel 40 or housing. The base 22 of the channel 40 defines two apertures 42, through which the locking members extend when in the locked position. Pivot pins 44 pivotally secure the locking members to the sides 46 of the U-shaped channel 40. A deadbolt insert 48 is secured near one end 50 of the U-shaped channel 40. The deadbolt insert 48 is installed in a bore within a typical pivoting door normally occupied by a conventional deadbolt. In closures having only a single bore, the deadbolt insert 48 may be installed in the bore utilized for the latch. A bar slide 52 is slidably mounted within the deadbolt insert 48, to guide substantially linear movement 54 of the bar slide 52 during use. The movement 54 of the bar slide 52 is generally along a substantially horizontal axis $A_H$. In other embodiments, such as those described with regard to FIGS. 7A-7B, the bar slide moves from a locked position to an unlocked position in a substantially linear direction. This linear direction may be at an angle from the horizontal axis $A_H$.

Figure 3A:
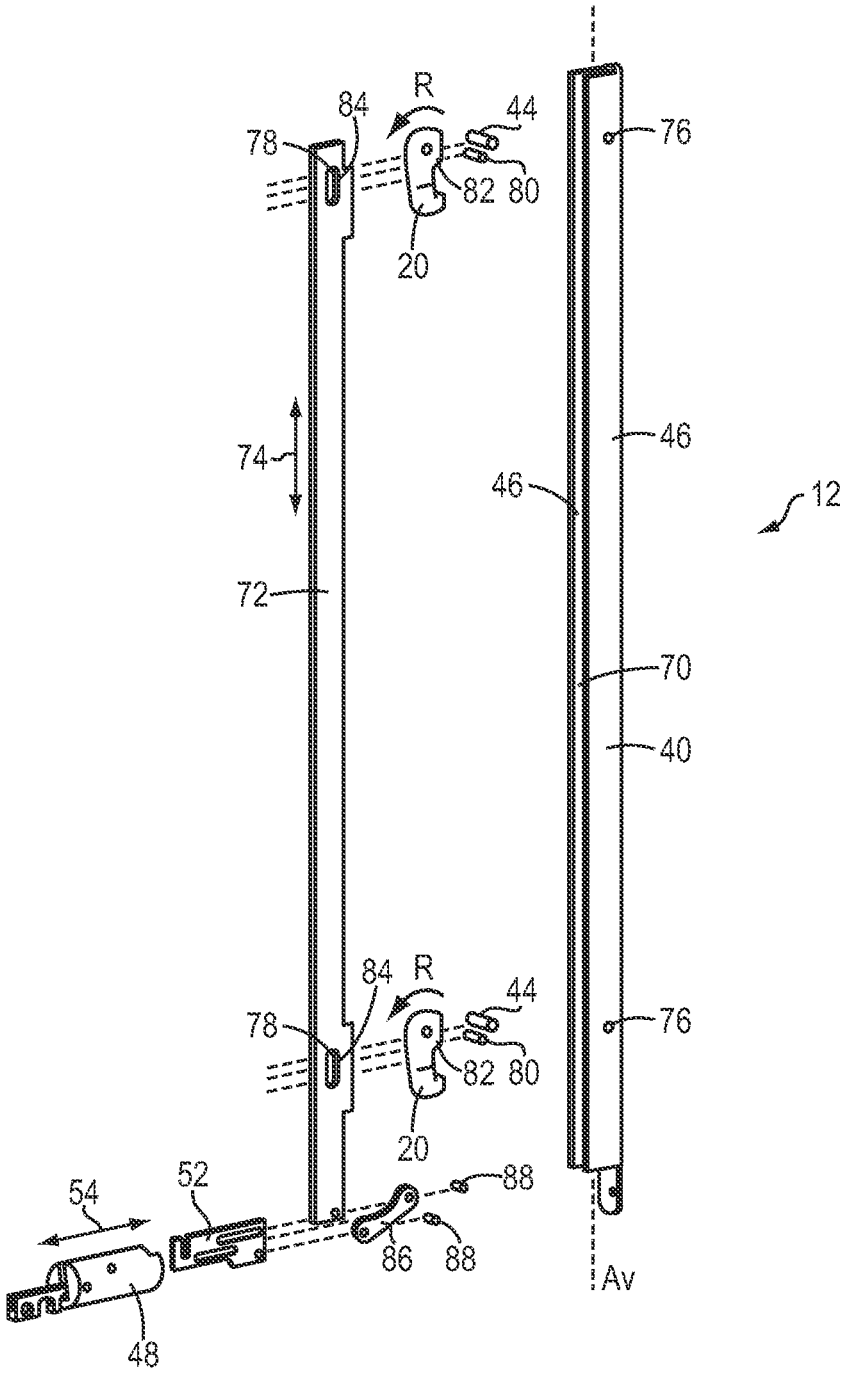
FIG. 3A is an exploded schematic perspective view of the multi-point door lock of FIG. 2.

FIG. 3A is an exploded schematic perspective view of the multi-point door lock 12 depicted in FIG. 2. The two sides 46 of the U-shaped channel 40 define an elongate void 70 therebetween. The elongate void 70 has a substantially vertical axis $A_V$. Disposed in the void 70 are the locking members 20 and a drive bar 72. The drive bar 72 moves in a substantially vertical direction 74 within the U-shaped channel 40 during use, as described in more detail below. The pivot pins 44 are inserted through openings 76 defined in one or both sides 46 of the U-shaped channel. Elongate slots 78 in the drive bar provide clearance for the pivot pins 44 during vertical movement 74 of the drive bar 72.

Each locking element 20 is connected to the drive bar 72 with a drive pin 80. Each drive pin 80 engages a drive pin opening 82 in the locking member 20, as well as a drive pin recess 84 in the drive bar 72. This connection is depicted with more clarity in FIGS. 5A and 5B. During use, as the drive bar 72 moves vertically 74 relative to the channel, and the drive pins 80 cause the locking members 20 to rotate R around pivot pins 44. When the drive bar 72 is raised, this rotation R extends the locking members 20 from a first, retracted position to a second, extended position. In the retracted position, the locking members 20 are contained within the U-shaped channel 40 and the door can be opened and closed. In the extended position, the locking members 20 extend beyond the face plate 22 of the U-shaped channel 40, engaging keepers (not shown) on the doorjamb, or in certain embodiments, on the locking edge face of an opposing door, in the case of a double door configuration, locking the door in a closed position.

The bar slide 52 moves horizontally 54 during use to raise and lower the drive bar 72 to actuate the multi-point lock 12. A translation member or transmission 86 translates the horizontal movement 54 of the bar slide 52 to vertical movement 74 of the drive bar 72. In the depicted embodiment, the translation member or transmission 86 is a bar link connected to the bar slide 52 and drive bar 72 with connection pins 88. In other embodiments, a pivoting member, pivoting gear, or rack and pinion mechanism may be utilized as the translation member. In still other embodiments, a cable housed in a rigid or semi-rigid cable stay may operate as the transmission.

Figure 3B:
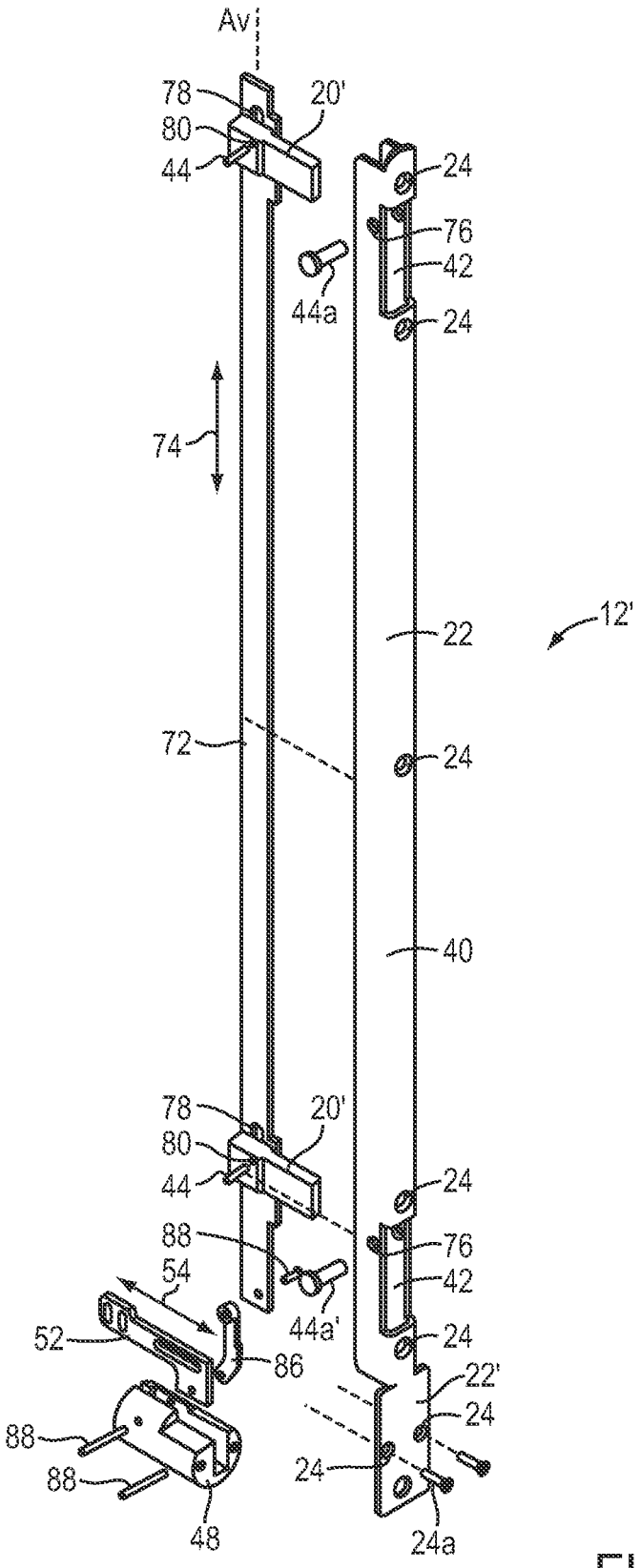
FIG. 3B is an exploded schematic perspective view of a multi-point door lock in accordance with another embodiment of the invention.

FIG. 3B is an exploded schematic perspective view of another embodiment of a multi-point door lock 12'. Most of the elements of the multi-point door lock 12' are described above with regard to FIG. 3A, and perform the same or substantially the same functions, as will be readily apparent to a person of ordinary skilled in the art upon reading the following description. Additional elements particular to this embodiment are described below. It is contemplated that elements described with regard to this embodiment of the multi-point door lock 12' may be utilized with the embodiment of the multi-point door lock 12 described in FIG. 3A. The multi-point door lock 12' is depicted with linear locking members 20' (as opposed to the hook-shaped locking members 20 in FIG. 3A). The locking members 20' are described in more detail with regard to FIG. 8, below. A rivet 44*a* is inserted over each pivot pin 44 to secure the locking member 20' relative to the U-shaped channel 40. A face plate extension 22' is incorporated into the lower end of the channel 40 to cover the opening 26*a* (depicted in FIG. 1). The face plate extension 22' may be secured to the deadbolt insert 48 utilizing one or more machine screws 24*a*. Securing the face plate extension 22' to the deadbolt insert 48 reduces or eliminates movement of the deadbolt insert 48 during use.

Figure 4A:
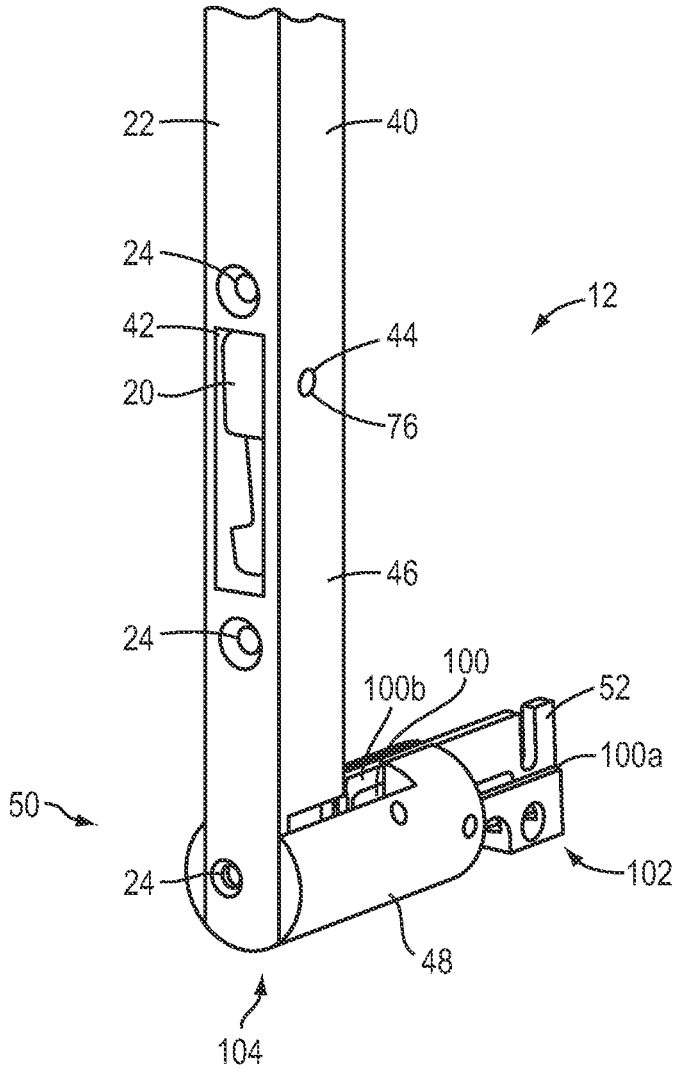
FIG. 4A is an enlarged partial schematic perspective view of the multi-point lock of FIG. 2 in the unlocked position.
Figure 4B:
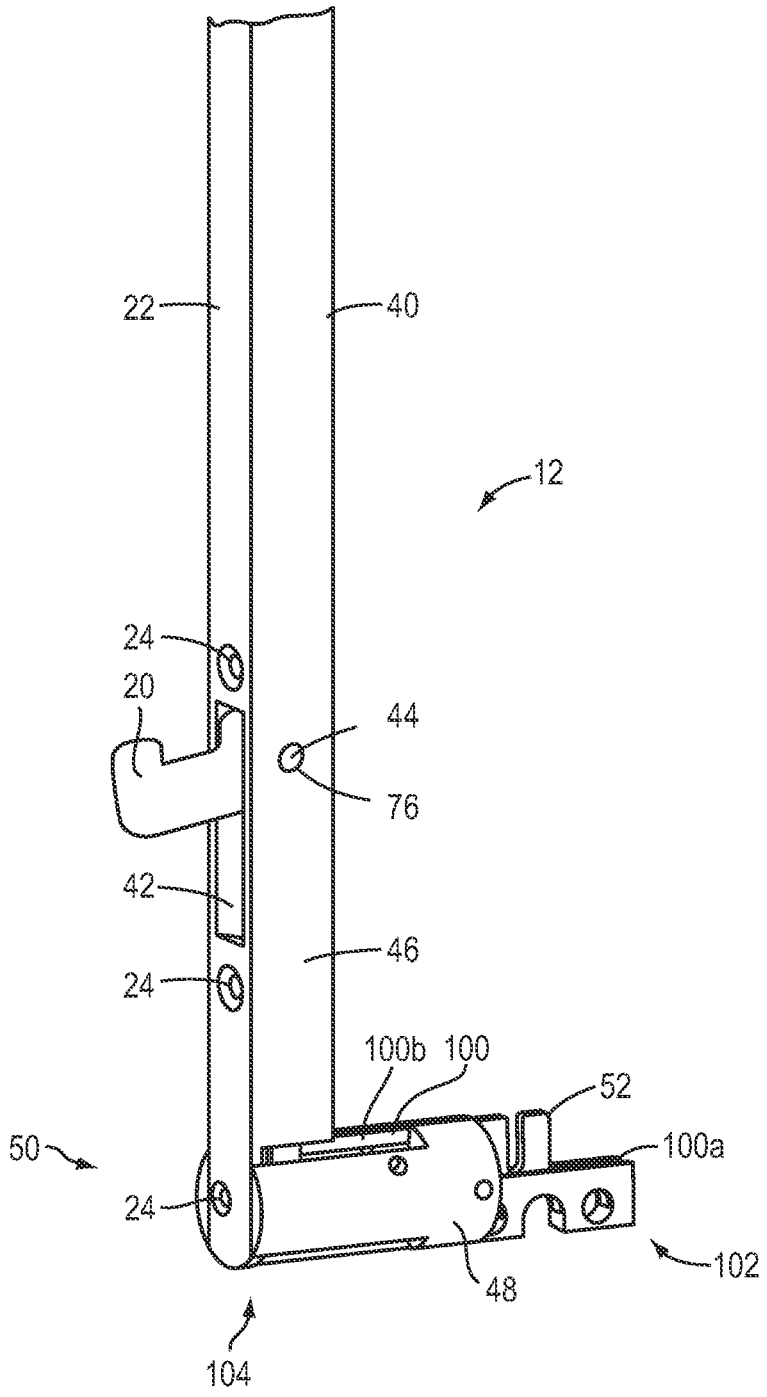
FIG. 4B is an enlarged partial schematic perspective view of the multi-point lock of FIG. 4A in the locked position.

FIGS. 4A and 4B depict enlarged partial schematic perspective views of the multi-point lock 12, in the unlocked and locked positions, respectively. The deadbolt insert 48 defines a longitudinal slot 100 of a constant or variable width. In the depicted embodiment, the slot 100 is narrow proximate the lock cylinder engagement end 102 of the deadbolt insert 48, and is wide proximate the drive bar engagement end 104. The narrow portion 100*a* of the slot 100 is sized to guide the bar slide 52 during horizontal movement, and prevent dislodgement of the slide bar 52 from the slot 100. The wide portion 100*b* of the slot is sized to accommodate the bar slide 52, the transmission 86, the connection pin 88 connecting those two elements, and an end of the channel 40. The lowermost screw hole 24 can accept a machine screw to attach the channel 40 to the insert 48.

Figure 5A:
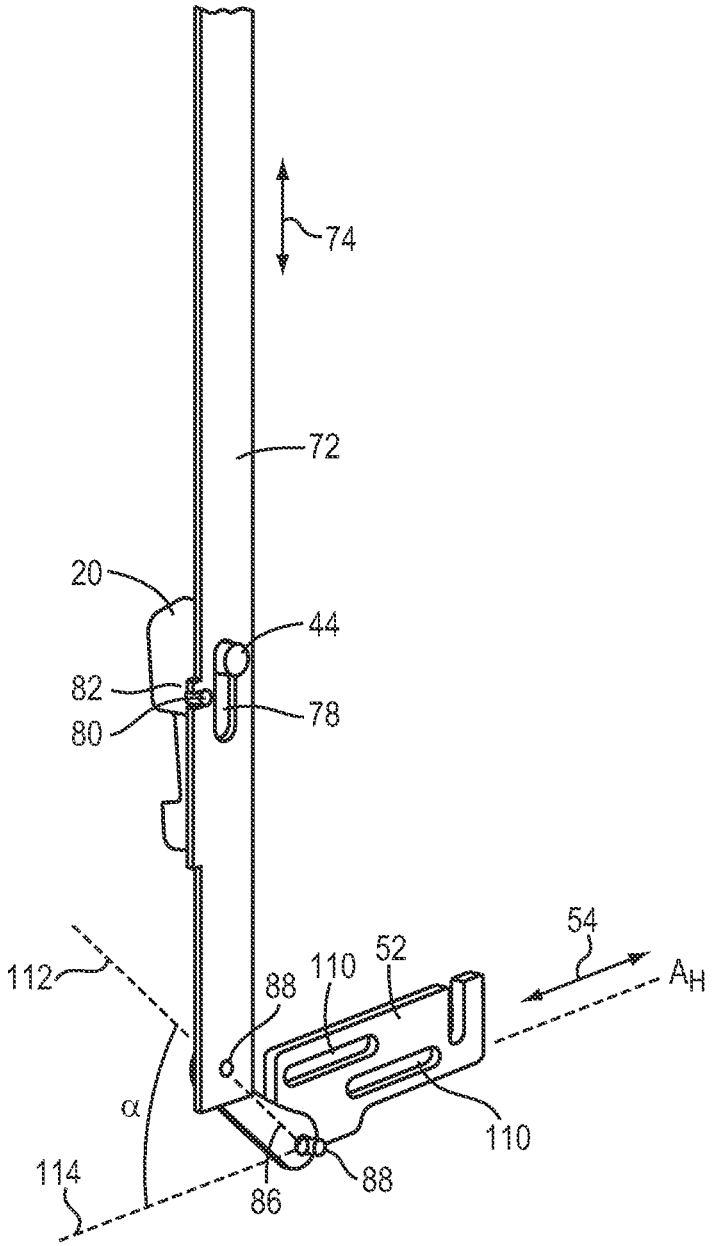
FIG. 5A is an enlarged partial schematic perspective view of the multi-point lock of FIG. 2 in the unlocked position with housing portions removed.
Figure 5B:
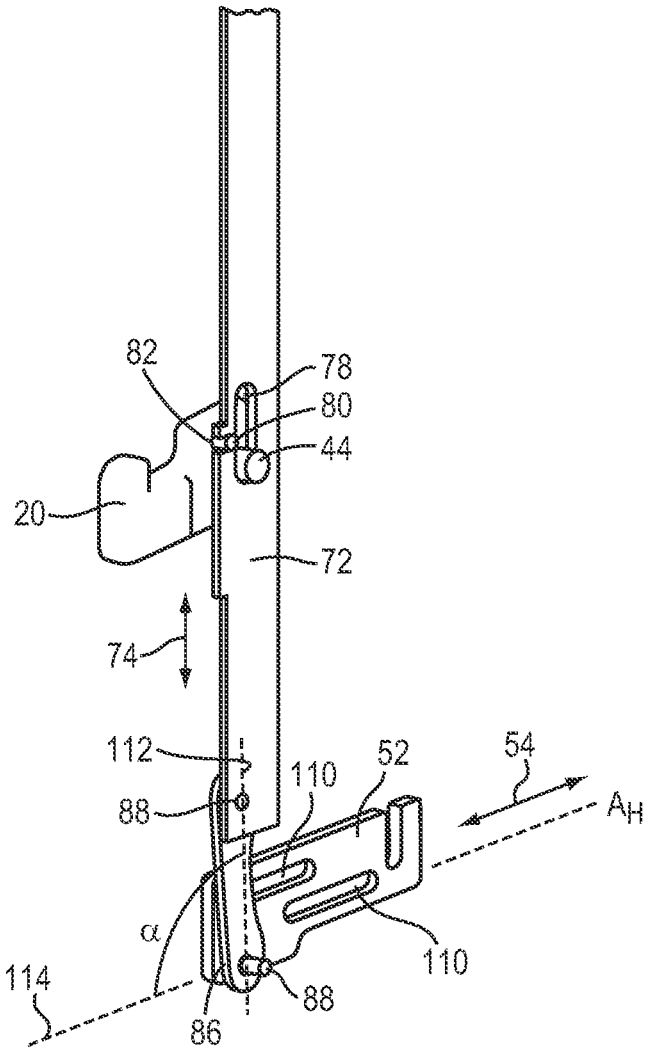
FIG. 5B is an enlarged partial schematic perspective view of the multi-point lock of FIG. 5A in the locked position.

FIGS. 5A and 5B depict enlarged partial schematic perspective views of the multi-point lock 12 of FIGS. 4A and 4B, respectively, with the deadbolt insert 48 and U-shaped channel 40 removed to facilitate depiction of the cooperation of the internal linkage mechanism of the lock 12. Additional detail regarding the bar slide 52 is depicted in these figures. Notably, the bar slide 52 includes one or more horizontal slots 110, sized to engage projections within the deadbolt insert 48. These slots 110 guide the bar slide 52 horizontally 54 during use. When the multi-point lock 12 is in the unlocked position, as depicted in FIG. 5A, a longitudinal axis 112 of the bar link 86, as defined by the connection pins 88, is at an acute angle $\alpha$ above a line 114 substantially parallel to the horizontal movement 54 of the bar slide 52 along the horizontal axis $A_H$. As the bar slide 52 is moved horizontally 54 to the left, the bar link 86 rotates (i.e., the angle $\alpha$ of the bar link 86 increases), which in turn forces vertical movement 74 of the drive bar 72 in the upward direction extending the locking members 20. As the bar slide 52 is moved horizontally 54 to the right, the translation member 86 counter-rotates (i.e., the angle $\alpha$ of the bar link 86 decreases), which in turn forces vertical movement 74 of the drive bar 72 in the downward direction retracting the locking members 20.

Figure 6A:
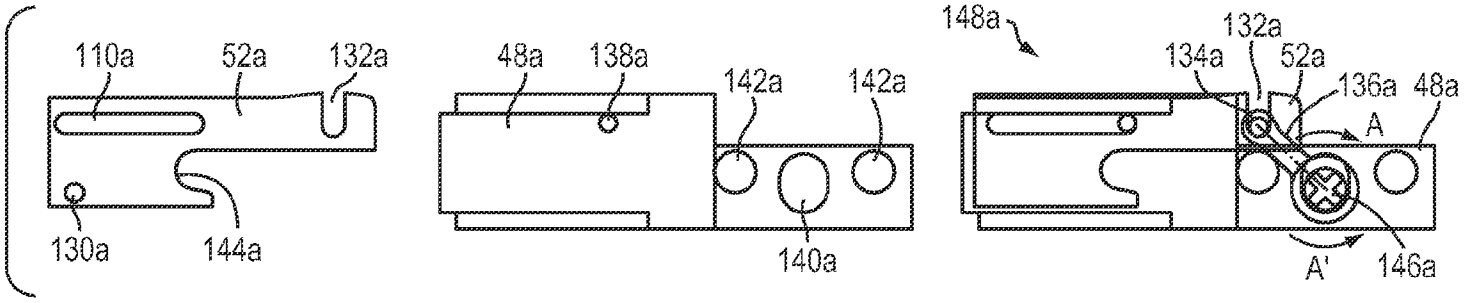
FIGS. 6A-6C are schematic side views of components and assembled versions of three variants of bar slide and deadbolt inserts in accordance with three embodiments of the invention.
Figure 6B:
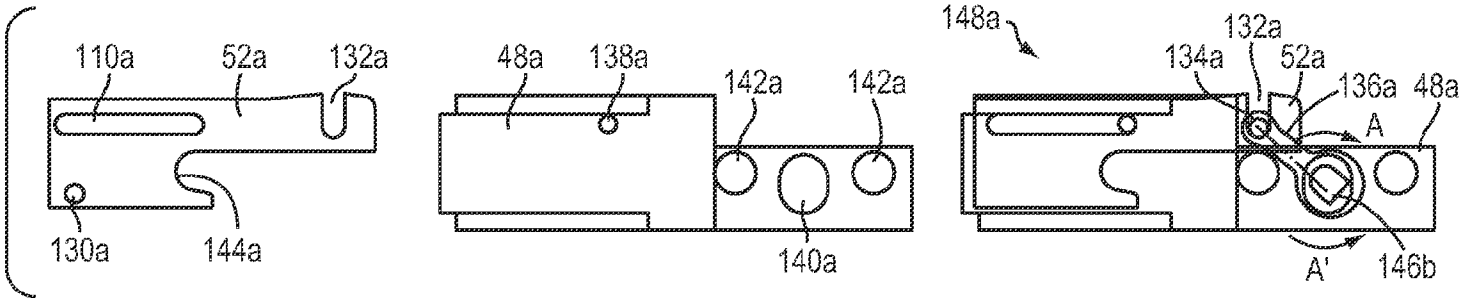
Figure 6C:
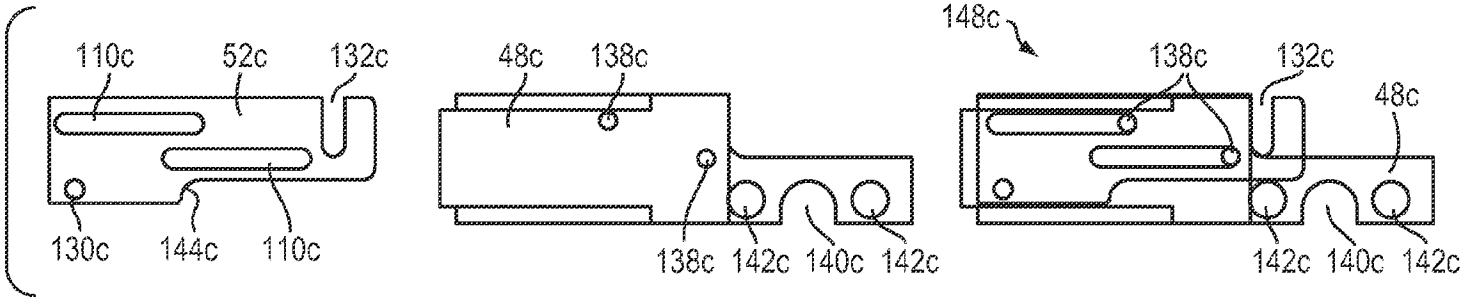

FIGS. 6A-6C depict schematic side views of bar slides and deadbolt inserts in accordance with three embodiments of the invention. These bar slides and deadbolt inserts may be utilized, generally, with the embodiment of the multi-point lock 12 depicted in FIG. 2. Other embodiments of the bar slides and deadbolt inserts to be utilized with the embodiment of the multi-point lock 12' depicted in FIG. 3B, are described below and depicted in FIGS. 7A and 7B. It is, however, contemplated to use any of the embodiments of the bar slides and deadbolt inserts depicted herein with any embodiments of the multi-point door locks depicted herein, as the structure and operation of the various elements are substantially similar.

With regard to FIG. 6A, the bar slide 52*a* is configured so as to slide within the slot of the deadbolt insert 48*a*. An end of the bar slide 52*a* defines an opening 130*a* sized to receive the connection pin 88. An opposite end of the bar slide defines a slot 132*a* configured to engage a cylinder pin 134*a* during movement of a lever arm 136*a*. A guide pin 138*a*, located within the slot of the deadbolt insert 48*a*, mates with the slot 110*a* to guide movement of the bar slide 52*a* within the deadbolt insert 48*a*. A number of openings 140*a*, 142*a* are defined by an end portion of the deadbolt insert 48*a*. The opening 140*a* is configured and located to accommodate a base 146*a* of the lever arm 136*a*. The openings 142*a* are configured and located to accommodate screws (not shown) that secure the thumb turn/lock cylinder combination to the door stile. Additionally, the bar slide 52*a* further defines a relief or mating curvature 144*a* to prevent interference with the securing screws. The base 146*a* of the lever arm 136*a* is configured to receive, in one side, a flat or X-shaped tailpiece of a lock cylinder (not shown). A tailpiece of a thumb turn (not shown) is received in the opposite side.

When in a combined configuration 148*a*, the lever arm 136*a* has driven the bar slide 52*a* to the left, which places the locking members (not shown) of the multi-point lock in the locked position. From the depicted position, rotating the lock cylinder or thumb turn in the direction depicted by A will force the lever arm 136*a* to rotate clockwise, which will slide the bar slide 52*a* to the right. In turn, this will retract the locking members. Rotating the lock cylinder or thumb turn in a counter-clockwise direction A' forces the lever arm 136*a* to slide the bar slide 52*a* to the left, thus extending the locking members. The components depicted in this combined configuration 148*a* may be utilized with a number of lock cylinder/thumb turn lock sets, including those made by MASTER, TRUBOLT, and DEFIANT, as well as DEXTER BY SCHLAGE, and others similarly configured. The configuration and location of the tailpiece and screws of the lock set can at least partially define the configuration and location of the base 146*a* of the lever arm 136*a* and the openings 140*a*, 142*a*.

In the combined configuration 148*b* depicted in FIG. 6B, the components utilized in the combined combination 148*a* of FIG. 6A are utilized for a lock cylinder/thumb turn lock set manufactured by KWIKSET, and others similarly configured. The base 146*b* is configured to accommodate a D-shaped tailpiece.

FIG. 6C depicts components utilized for a lock cylinder/thumb turn lock set manufactured by SCHLAGE. Similar to the configurations depicted in FIGS. 6A and 6B, the bar slide 52*c* is configured so as to slide within the slot of the deadbolt insert 48*c*. An end of the bar slide 52*c* defines an opening 130*c* sized to receive the connection pin 88. An opposite end of the bar slide defines a deep slot 132*c* configured to engage a cylinder pin (not shown) during movement of a lever arm (not shown). Two guide pins 138*c*, located within the slot of the deadbolt insert 48*c*, mate with a corresponding number of slots 110*c* to guide movement of the bar slide 52*c* within the deadbolt insert 48*c*. A number of openings 140*c*, 142*c* are defined by an end portion of the deadbolt insert 48*c*. The opening 140*c* is a relief along one edge and is configured and located to accommodate a base (not shown) of the lever arm (not shown). The openings 142*c* are configured and located to accommodate screws (not shown) that secure the thumb turn/lock cylinder combination to the door stile. Notably, the opening 140*c* is at least partially defined by the deadbolt insert. As can be seen from the figures, the openings 140*c*, 142*c* are located lower on the deadbolt insert than the openings 140*a*, 142*a*, depicted in FIGS. 6A and 6B. This is to accommodate the particular configuration of the lock cylinder/thumb turn lock set manufactured by SCHLAGE. Additionally, the bar slide 52*c* further defines a mating curvature 144*c* to prevent interference with the securing screws. The base (not shown) of the lever arm (not shown) is configured to receive, on one side, a tailpiece of a lock cylinder (not shown). A tailpiece of a thumb turn (not shown) is received in the opposite side. With regard to FIGS. 6A-6C, other lever arm configurations are contemplated to allow use of the multi-point lock in conjunction with deadbolt hardware (e.g., lock cylinders and actuators) manufactured by other hardware manufacturers. Further details regarding operation of the multi-point lock are described with regard to FIGS. 10A-10C.

Figure 7A:
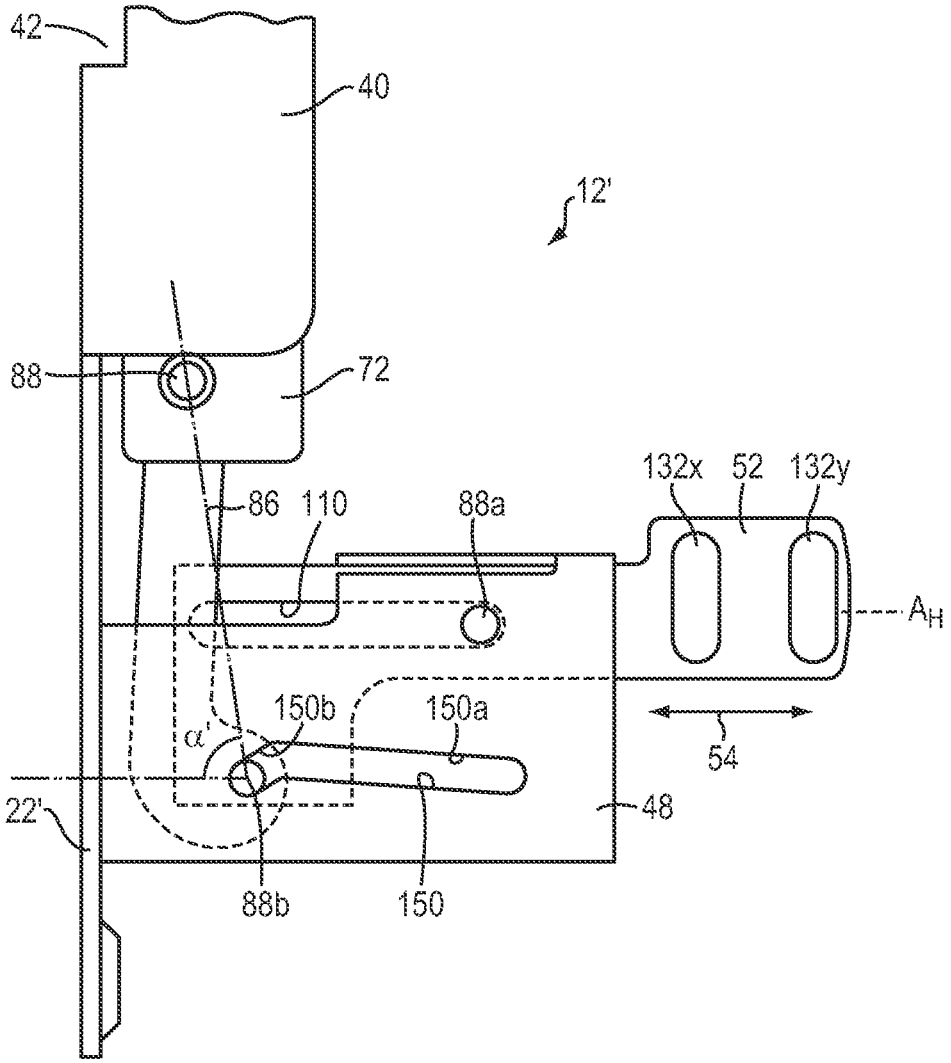
FIG. 7A is an enlarged partial schematic side view of the multi-point lock of FIG. 3B in the locked position.
Figure 7B:
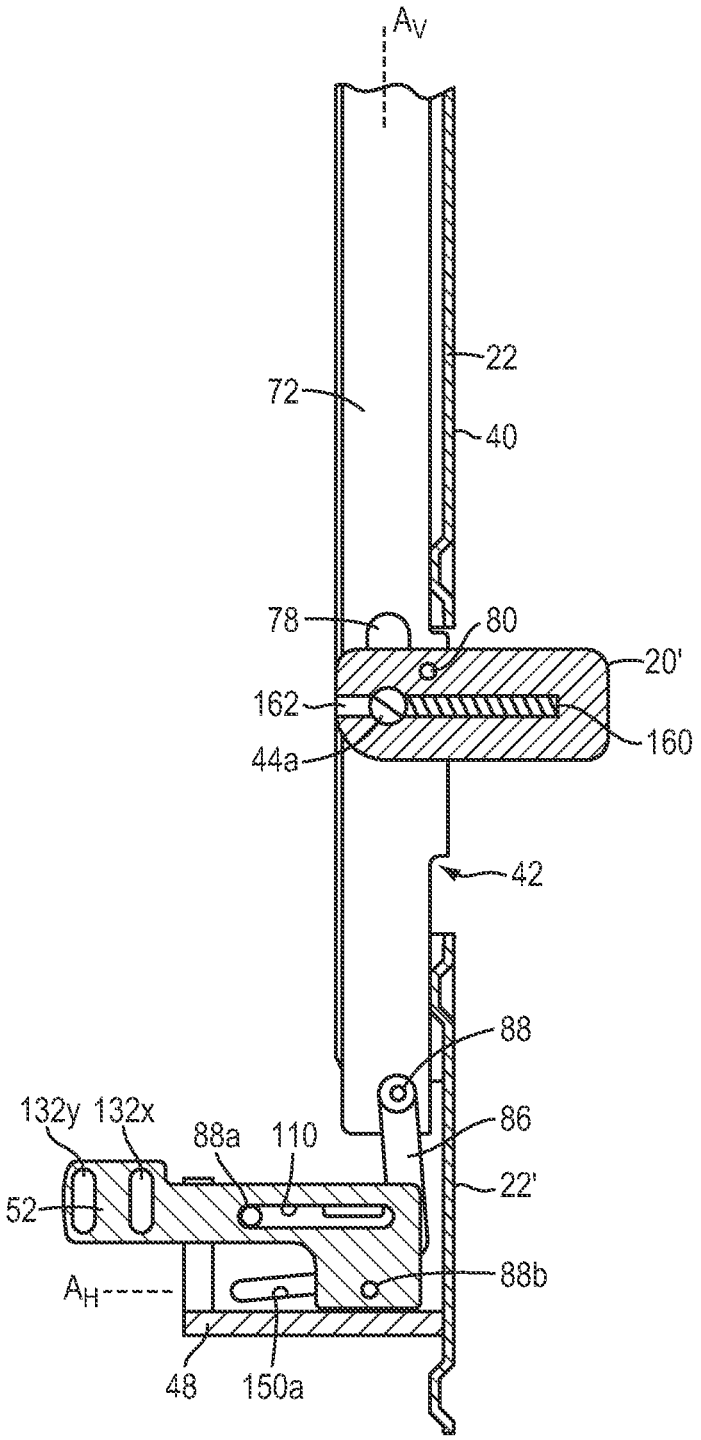
FIG. 7B is an opposite-side enlarged partial schematic section view of the multi-point lock of FIG. 7A in the locked position.

FIG. 7A is an enlarged partial schematic side view of the multi-point lock 12' of FIG. 3B in the locked position. FIG. 7B depicts lock 12', in section, viewed from the opposite side depicted in FIG. 7A. Most elements depicted in the figures are described above with regard to preceding figures, and perform the same or substantially the same functions, as apparent to a person of ordinary skilled in the art. Addition elements particular to this embodiment are described below. It is contemplated that elements described with regard to this embodiment of the multi-point door lock 12' may be utilized with the embodiment of the multi-point door lock 12 described in FIG. 3A. The lock 12' includes a deadbolt insert 48 and a bar slide 52, adapted to slide therein. As described above, pin 88*a* is secured to the deadbolt insert 48 and defines a maximum travel of the bar slide 52 due to interference with the extreme ends of the slot 110.

The deadbolt insert 48 defines an elongate slot 150 and is secured to the cover plate extension 22'. The slot 150 includes a first linear travel portion 150*a* that guides the motion of pin 88*b* as the bar slide 52 moves horizontally 54 along the horizontal axis $A_H$. The slot 150 terminates at a second locking portion or detent 150*b* oriented at an angle to the first travel portion 150*a*. In this position of the pin 88*b* depicted in FIGS. 7A and 7B, a force applied to the deadbolt 20' will be unable to back the pin 88*b* out of the detent 150*b*, thus preventing forced manipulation of the deadbolt 20' in an effort to defeat the lock 12'. A number of slots 132*x*, 132*y* (e.g., two vertically disposed closed end slots) are defined by the bar slide 52 to engage a lever arm connected to a cylinder pin. The slot 132*x* is configured to accommodate lock cylinder pins and actuators having 2⅜" backsets; the slot 132*y* is configured to accommodate lock cylinder pins and actuators having 2¾" backsets. The 2⅜" and 2¾" backsets are common across a wide range of manufacturers; slots configured to accommodate different backsets are contemplated. The configuration of the bar slide 52 and deadbolt insert 48 depicted in FIG. 7A allows the multi-point lock 12' to be used with a variety of lock cylinder configurations available in the market. Other bar slide configurations to accommodate different lock cylinder and/or actuator configurations are also contemplated.

As depicted in FIG. 7B, the locking member 20' defines a hollow central bore, into which a hardened steel or other metal pin 160 is inserted. During assembly of the lock 12' the hardened pin 160 is inserted via an access channel 162, after which the locking member 20' is secured via the rivet 44*a* to the U-shaped channel 40. Both the hardened pin 160 and rivet 44*a* are a slight clearance fit within the locking member 20'. The clearance fit between the hardened pin 160 and the locking member 20' prevents the locking member 20' from being cut through in an effort to defeat the lock 12'. To the extent a person could access and begin to saw through the locking member 20', the hardened pin 160 has sufficient clearance within the locking member 20' to rotate circumferentially when contacted by the saw blade, thus preventing cutting of the pin 160 and complete cutting through of the locking member 20'.

Figure 8A:
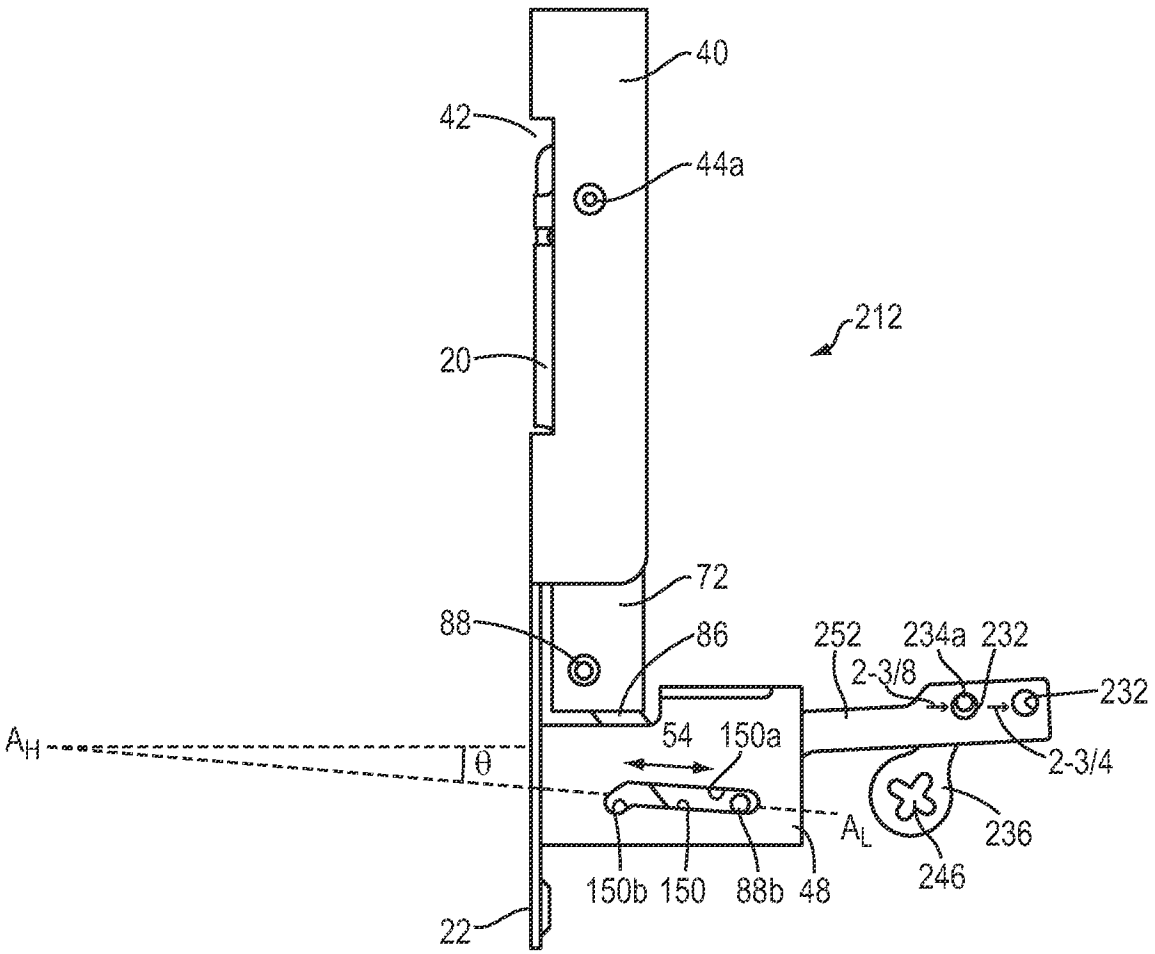
FIGS. 8A-8C are enlarged partial schematic side views of a multi-point lock in accordance with another embodiment of the invention, in the unlocked, intermediate, and locked positions, respectively.
Figure 8B:
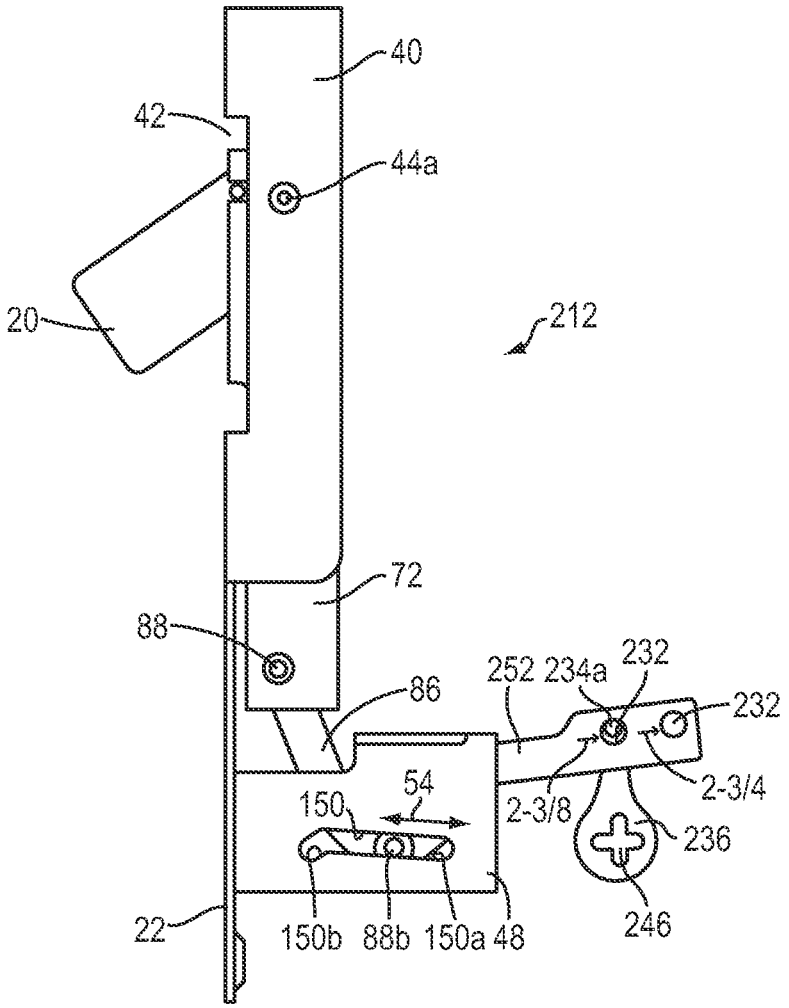
Figure 8C:
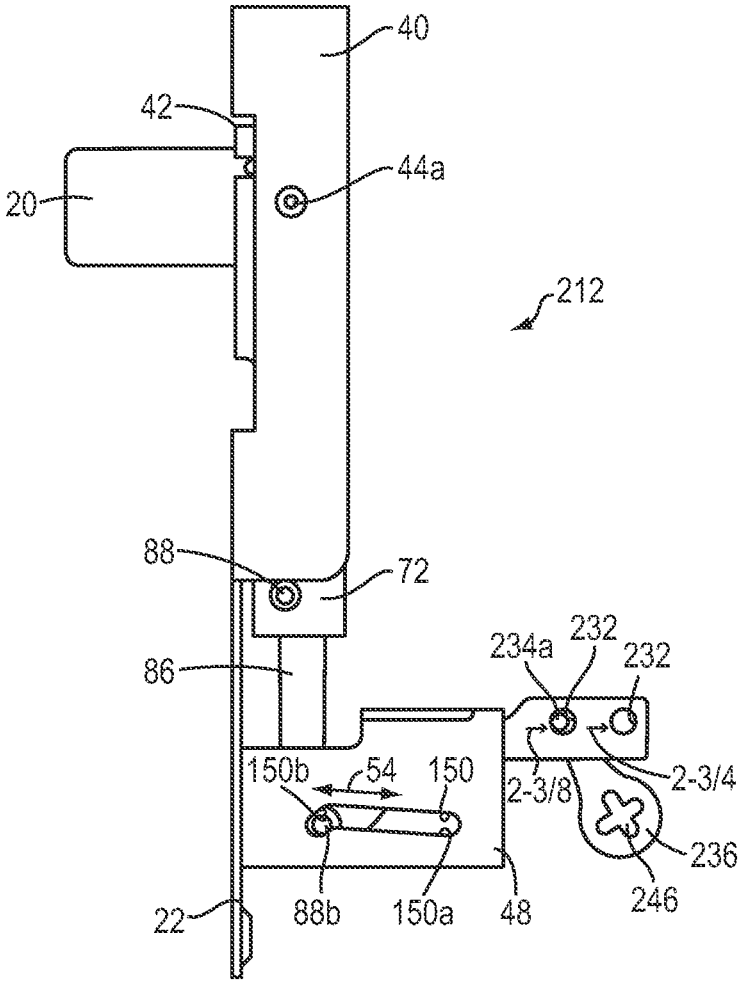

FIGS. 8A-8C are enlarged partial schematic side views of another embodiment of a multi-point lock 212 in the unlocked, intermediate, and locked positions, respectively. Structure and operation of many of the components of the lock 212 are described above with regard to the locks 12 and 12'. The lock 212 includes a bar slide 252. This bar slide 252 is configured so as to operate with a large variety of locking cylinder and deadbolt hardware manufactured by a variety of manufacturers. The structural and operational aspects of this bar slide 252 are described below. The bar slide 252 defines two round openings 232, although openings having other shapes are contemplated. During operation, one of the openings 232 engages a cylindrical pin 234*a*, which is driven by pivotal movement of a lever arm 236. Movement of the lever arm 236 is driven by rotational movement of a tailpiece from a lock cylinder or thumb turn that engages with an opening 246 defined by the lever arm 236. Pivoting of the lever arm 236 forces a distal end of the bar slide 252 to move 54 linearly along an axis $A_L$ from the unlocked to the locked position, via an intermediate position. In the depicted embodiment, the linear axis $A_L$ is oriented at an acute angle θ to the horizontal axis $A_H$. In other embodiments, the linear axis $A_L$ may be parallel to or collinear with the horizontal axis $A_H$.

Figure 8D:
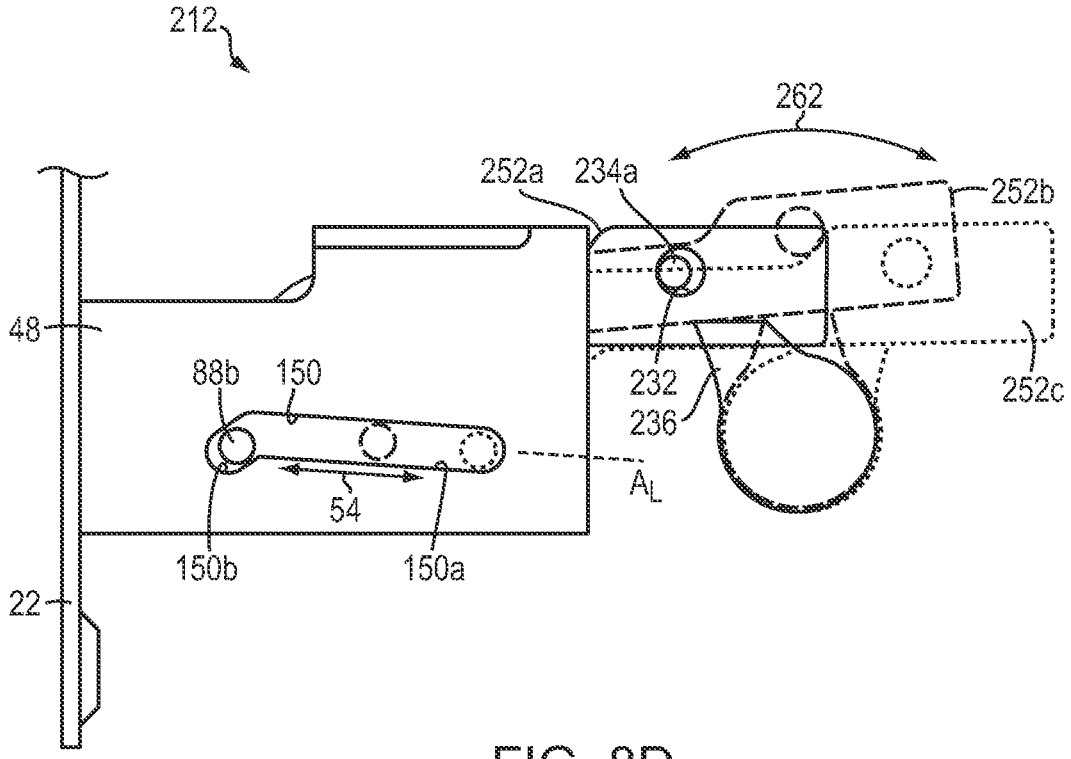
FIG. 8D is an enlarged partial schematic side view of the bar slide and lever arm of the multi-point lock of FIGS. 8A-8C.

The configuration of the bar slide 252 prevents binding of the mechanism or interference of the various moving parts. During movement 54 of the bar slide 252 from the locked to the unlocked position, the two ends of the bar slide 252 move respectively along linear and arcuate paths to prevent binding of the lock mechanism. FIG. 8D illustrates this movement of the two ends. In FIG. 8D, the bar slide 252*a* in solid line depicts the bar slide in the locked position, the bar slide 252*b* in dashed line depicts that element in an intermediate position, and the bar slide 252*c* in dotted line depicts that element in the unlocked position. The line types also correspond to the positions of the pin 88*b*, opening 232, and lever arm 236 in the three depicted positions.

The distal end of the bar slide 252 is connected to the transmission bar link (not shown in FIG. 8D) with the pin 88*b*. Due to the location of the pin 88*b* within the slot 150, this end of the bar link is constrained to move substantially linearly 54 in the travel slot 150*a*, in this case, along the linear axis $A_L$. At the end of travel slot 150*a*, the pin drops into a detent 150*b*, which locks the lock 212 against forced opening. One round opening 232 is depicted in FIG. 8D for clarity and engages with the cylindrical pin 234*a* during operation. As the lever arm 236 rotates, the cylinder pin 234*a* exerts a force against the bar slide 252. Due to the round openings 232, the proximal end of the bar slide 252 moves along an arcuate path 262 to match the movement of the cylindrical pin 234*a*. In the lock 12' depicted in FIGS. 7A and 7B, the pin 88*a* constrains movement of the proximal end of the bar slide 52, preventing arcuate movement of that end, thus necessitating the oblong openings 132'. Due to the absence of any movement-restricting pin in the lock of FIG. 8D, however, the bar slide 252 is able to translate with reduced friction and without binding, so that the lock 212 operates smoothly.

Figure 9:
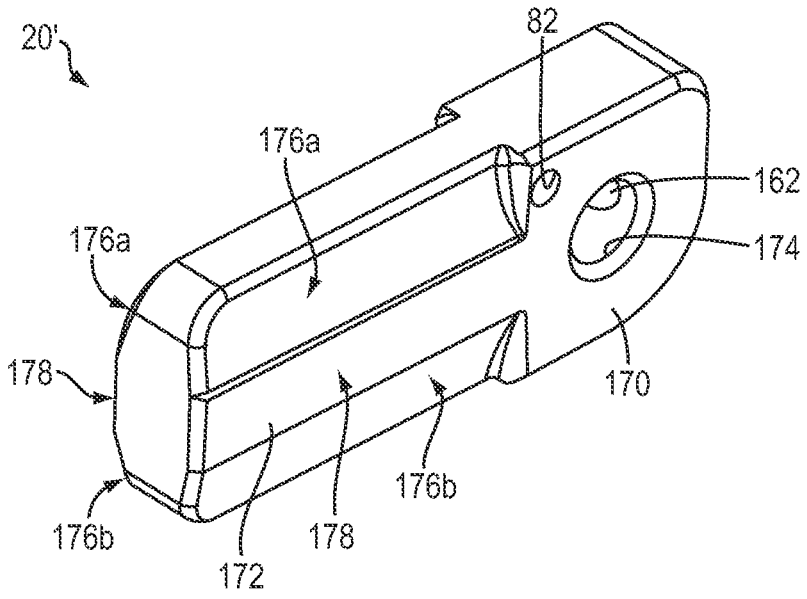
FIG. 9 is a schematic perspective view of a locking member in accordance with one embodiment of the present invention.

FIG. 9 is a schematic perspective view of the linear locking member 20' in accordance with one embodiment of the present invention. The locking member 20' includes a base section 170 and a bolt section 172. The base section 170 defines a drive pin opening 82 for receipt of a drive pin and a pivot pin opening 174 for receipt of a pivot pin and, if utilized, a pin sheath. The bolt section 172 includes tapered surfaces 176 to improve performance of the lock, especially when the lock is installed in a warped panel door, or in a door where the associated frame settles or shifts over time. The tapered leading surfaces 176*a* provide a lead-in to the strike located on the door jamb. The tapered trailing surfaces 176*b* reduce potential surface contact between the bolt section 172 and the strike, this reducing operational forces on the lock.

Figure 10C:
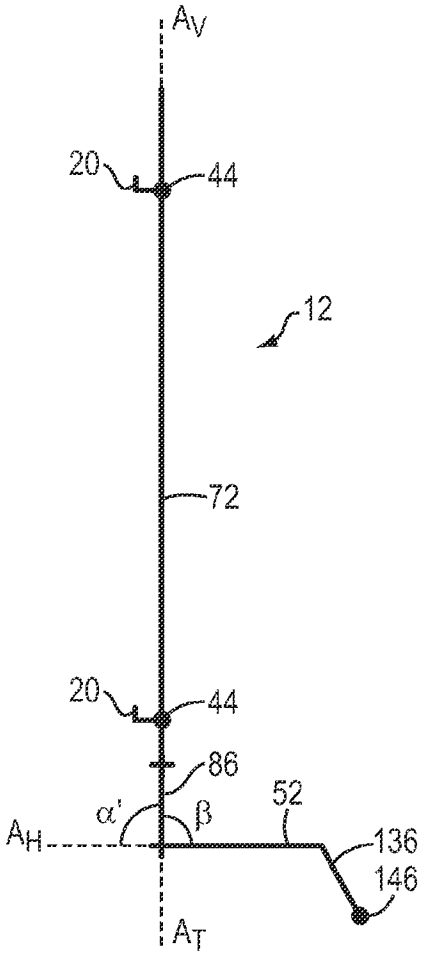
FIGS. 10A-10C depict a kinematic linkage representation of a multi-point lock in accordance with one embodiment of the present invention, in the unlocked, operating, and locked positions, respectively.
Figure 10B:
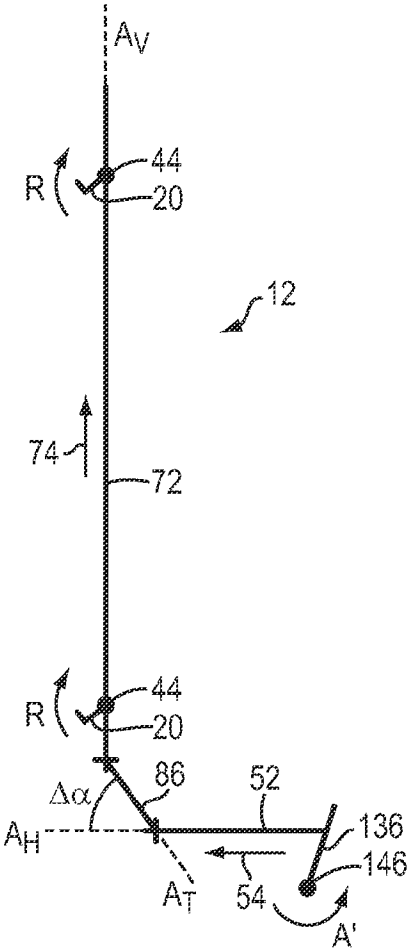
Figure 10A:
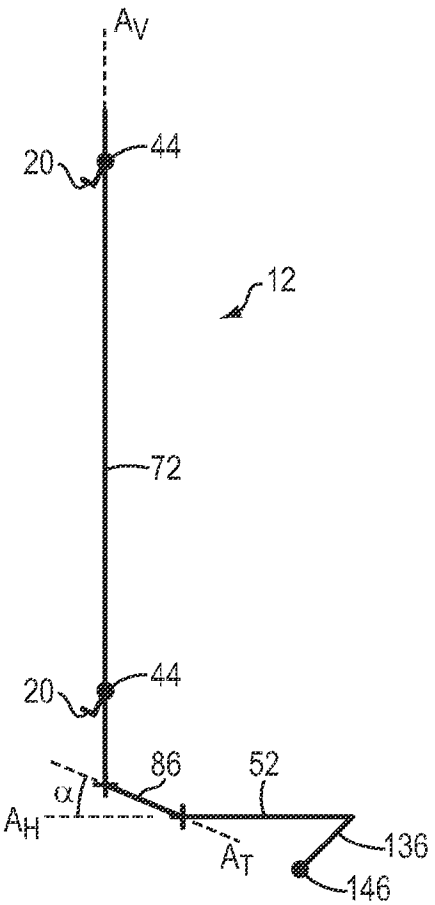

FIGS. 10A, 10B, and 10C depict a kinematic linkage representation of the multi-point lock 12 in the unlocked, operating, and locked positions, respectively. During lock operation (unlocked, transition, and locked), there are three fixed points of the multi-point lock 12: the axes of rotation about the locking member pivot pins 44 and of the lever arm 136 (depicted at pivot point 146). All other elements depicted in FIGS. 10A-10C move relative to those fixed points. FIG. 10A depicts a first, or unlocked position of the multi-point lock 12. In this position, the bar slide 52 is in a first, right position. A transmission axis $A_T$ is positioned at the angle α above the horizontal axis $A_H$. The transmission axis $A_T$ may be defined, in one embodiment, by the two points of connection of the transmission 86 to the drive bar 72 and the bar slide 52. In certain embodiments, angle α is substantially zero, such that transmission axis $A_T$ and the horizontal axis $A_H$ are at or near parallel or collinear. Drive bar 72 is in a first, down position. Locking members 20 are in a first, retracted position.

FIG. 10B depicts the multi-point lock 12 during operation (as the lock 12 is being transitioned to the locked position of FIG. 10C). Upon rotation A' of the lock cylinder or thumb turn (not shown) at the lever arm pivot point 146, the lever arm 136 forces horizontal movement 54 of the bar slide 52 from the right to the left. Due to the drive bar 72 being constrained against horizontal movement by pivot pins 44, the end of transmission 86 in connection with the drive bar 72 is similarly constrained. As a result, that end of the transmission 86 is forced upward, thereby increasing the angle Δα between the transmission axis $A_T$ and the horizontal axis $A_H$. Rotational movement of the transmission 86 forces the drive bar 72 in a vertical direction 74. As described above, this vertical movement 74 of the drive bar 72 forces (via the drive pins 80) the locking members 20 to rotate R outwardly.

Once rotation A' of the lever arm 136 is complete, the multi-point lock 12 reaches its locked position, as depicted in FIG. 10C. In this position, the locking members 20 are fully extended to engage keepers on an opposing doorjamb or locking edge face of another door. Also, angle α' reaches or exceeds approximately 90 degrees, although other angles are contemplated. In this position, transmission axis $A_T$ is substantially collinear or parallel with the substantially vertical axis $A_V$. This orientation prevents the drive bar 72 from being driven in a downward position due to manipulation of the locking members 20 in an effort to defeat the lock 12.

The configuration and sizes of the various elements of the lock 12 may determine the locked positions of the elements, such that the angle α' exceeds 90 degrees, in which case, an angle β supplementary thereto is less than 90 degrees. In other embodiments, the locked position may include an angle α' less than 90 degrees, and an angle β in excess of 90 degrees. This latter embodiment, where the angle α' is less than 90 degrees, is depicted in FIGS. 7A and 7B. In embodiments where the angle α' is less than 90 degrees (and where a locking slot portion 150*b* is not utilized), if the locking members 20 are forced downward from their extended positions with sufficient force, the corresponding downward movement of the drive bar 72 will force the transmission 86 against the bar slide 52 and transmit load to the lock cylinder pin and lever arm. It may therefore be desirable to reinforce the lock cylinder pin and lever arm to prevent an aggressive attack from forcing the slide 52 to move to the right in FIGS. 7A and 10C, thus unlocking the lock 12. In embodiments of the lock 12 having an angle α' greater than 90 degrees (and therefore, an angle β less than 90 degrees), downward movement of the bar drive 72 due to forced rotation of the locking members 20 will force movement of the bar slide 52 to the left (in FIGS. 7A and 10C). As the bar slide 52 is already at the limit of its horizontal movement 54, this will prevent the lock 12 from being defeated.

Figure 11:
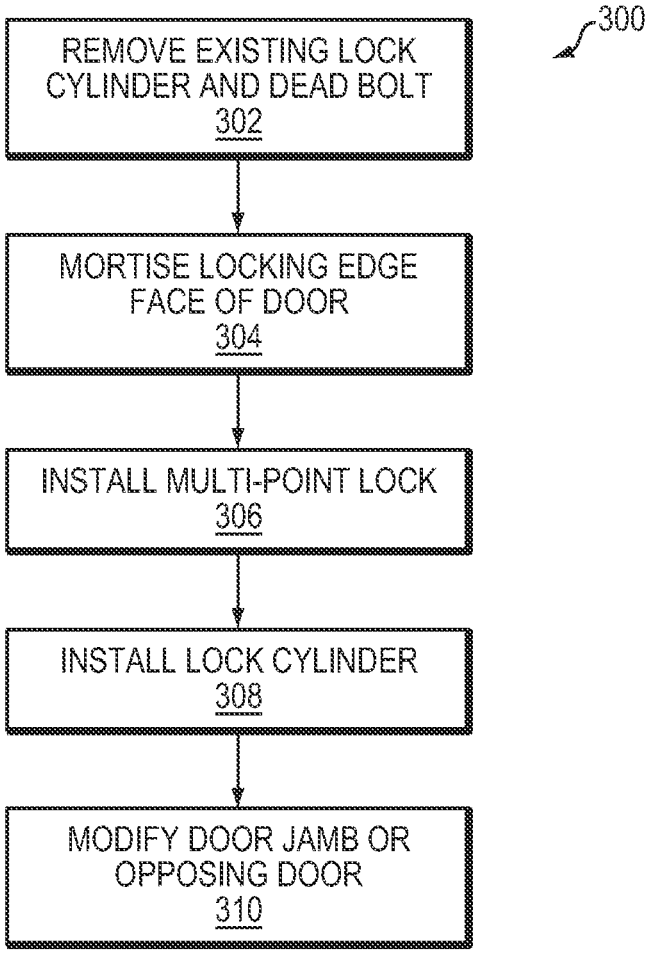
FIG. 11 is a flowchart depicting a method for installing a multi-point lock in accordance with one embodiment of the invention.

FIG. 11 depicts a method of installing a multi-point door lock in a pivoting door 300 in accordance with an embodiment of the present invention. The method 300 may be practiced on an existing pivoting door currently utilizing a conventional deadbolt and lock cylinder configuration. The depicted method 300 may also be used, in part, to install a new multi-point door lock in a manufactured door that not yet been installed. For existing doors that already utilize a standard deadbolt-type lock, the existing lock cylinder and deadbolt are first removed 302. Next, a groove or recess is formed in a locking edge side of the door 304, by routing or other suitable techniques. As described above, the groove or recess should be deep enough to receive the channel 40 and extend lengthwise to at least partially intersect the bore formerly housing the deadbolt. Newly manufactured doors may have a recess formed directly in the locking edge face during manufacturing, or may be mortised as required prior to or after installation.

Thereafter, the new multi-point door lock is installed in the groove formed in the door 306 and secured with screws. This step may include installing the cover plate, as well, if desired. Finally, the lock cylinder and related hardware (e.g., escutcheon plates, interior thumb turns, etc.) are installed 308. In certain embodiments, the same locking cylinder/thumb turn lock set that operated the deadbolt may be utilized with the multi-point lock. This will be dependent on the cooperation between the tailpieces of the lock set and the base 146 of the lever arm 136. In particular, it may be relevant to consider the shape of the tailpiece, the shape of the base 146 of the lever arm 136, the location of the one or more of the openings (identified, e.g., as 140*a*, 142*a*, etc.) within the deadbolt insert 48, or other factors. If the existing lock set can not be used, a new set having a configuration that mates properly with the components of the multi-point lock may be used. As a final step of the method, the opposing doorjamb or locking edge side of an opposing door is modified 310 to include a number of keepers matching the number and location of locking elements present in the multi-point lock.

In addition to the single-housing, dual-multi-point lock described herein, other configurations of the multi-point lock described herein are also contemplated. For example, the multi-point lock may include fewer than or greater than two locking members. For a particular multi-point lock, the locking member, drive bar, and drive pin may be configured to allow the locking members to rotate clockwise or counter-clockwise to reach an extended position. Additionally, the same multi-point lock may utilize locking members that rotate in opposite directions as they extend during use. The locking members may be a substantially uniform shape or any shape desired. It is contemplated that the various components and configurations depicted with regard to the multi-point locks disclosed herein, as well as modifications thereof envisioned by a person of ordinary skill in the art, are interchangeable. By way of example, and without limitation, the various bar slide configurations, deadbolt configurations, etc., may be selected based on factors such as application, cost, expected locking force requirements, etc.

The embodiment depicted in the figures is installed in an upright position (i.e., the multi-point lock extends upward from the deadbolt insert). Multi-point locks such as those described herein may also be installed in a downward configuration, which may be desirable for certain doors. For example, for additional security on a set of double pivoting doors, the one door may have a multi-point lock installed in an upright configuration, and the opposite door may have a multi-point lock installed in a downward configuration. Alternatively, one bar slide may be configured to drive a multi-point lock having multiple transmissions and multiple drive bars. For example, the insert deadbolt may be configured to accommodate two transmissions, one configured to drive an upright drive bar (as depicted in the attached figures), the other configured to drive a downward drive bar.

Additionally, the multi-point lock described herein that is used in conjunction with standard lock cylinders and hardware may also include locking members that extend above the top of the door and below the bottom of the door. In this case, the end of the drive bar may be configured to mate with an associated keeper on the top or bottom of the door frame. This top or bottom locking capability may be used with or without the rotating locking elements described herein.

The various elements of the locks depicted herein may be manufactured of any materials typically used in door hardware/lock manufacture. Such materials include, but are not limited to, cast or machined steel, stainless steel, brass, titanium, etc. Material selection may be based, in part, on the environment in which the lock is expected to operate, material compatibility, manufacturing costs, product costs, etc. Additionally, some elements of the lock may be manufactured from high-impact strength plastics. Such materials may be acceptable for applications where robust security is less critical, or when a secondary, stronger material is utilized in conjunction with the plastic part (for example, a plastic locking member used in conjunction with a hardened pin manufactured of metal).

While there have been described herein what are to be considered exemplary and preferred embodiments of the present invention, other modifications of the invention will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the invention. Accordingly, what is desired to be secured by Letters Patent is the invention as defined and differentiated in the following claims, and all equivalents.

What is claimed is:

1. A door lock comprising:

an elongate housing;

an insert housing defining a slot, wherein the insert housing is secured to the elongate housing;

a bar slide adapted for movement from a first position to a second position, wherein the bar slide is adapted to be actuated by a movement of a lever arm, and wherein the bar slide is disposed at least partially in the slot;

a locking member adapted for movement from a retracted position within the elongate housing to an extended position out from the elongate housing upon movement of the bar slide from the first position to the second position; and a transmission for coupling movement of the bar slide with movement of the locking member, wherein the transmission extends from the insert housing to the elongate housing.

2. The door lock of claim 1, wherein the transmission comprises a bar link and a drive bar.

3. The door lock of claim 2, wherein the bar link is connected to both the drive bar and the bar slide with a pin connection.

4. The door lock of claim 1, wherein the elongate housing is disposed below the insert housing when the door lock is installed in a locking edge side of a door.

5. The door lock of claim 1, wherein the elongate housing is connected to the insert housing.

6. The door lock of claim 1, wherein the locking member is pivotably mounted in the elongate housing.

7. The door lock of claim 6, wherein the transmission is connected to the locking member at a drive pin.

8. The door lock of claim 7, wherein the transmission comprises a bar link and a drive bar.

9. The door lock of claim 8, wherein the bar link is connected to the bar slide and the drive bar is connected to the locking member at the drive pin.

10. The door lock of claim 4, wherein the elongate housing is disposed in a substantially vertical orientation when the door lock is installed in the locking edge side of the door, and the insert housing is disposed in a substantially horizontal orientation when the door lock is installed in the locking edge side of the door.

11. The door lock of claim 1, wherein the insert housing defines an axis wherein the slot is disposed at an angle to the axis.

12. The door lock of claim 1, wherein the slot comprises a travel slot and a detent, wherein the detent is disposed at an angle to the travel slot.

13. A door lock comprising:

an elongate housing comprising a channel and a base;

an insert connected to the base, wherein the insert defines a pin slot;

a bar slide at least partially disposed in the insert;

a transmission at least partially disposed in the insert;

a drive bar at least partially disposed in the channel of the elongate housing and connected to the transmission;

a locking element movably engaged with the drive bar; and a pin connecting the bar slide and the transmission, wherein the pin is configured to slide in the pin slot.

14. The door lock of claim 13, wherein the insert defines an axis and wherein the pin slot is disposed at an angle to the axis.

15. The door lock of claim 13, wherein the drive bar is moveable between a first position and a second position, and wherein between the first position and the second position, the drive bar extends the locking element from the elongate housing.

16. The door lock of claim 15, wherein the locking element is connected to the elongate housing with a pivot pin and wherein the locking element is connected to the drive bar with a drive pin.

17. The door lock of claim 14, wherein the pin slot further comprises a detent.

18. The door lock of claim 13, the bar slide is configured to be positioned in a first position and a second position.

19. The door lock of claim 18, wherein a first end of the bar slide is configured to move in an arcing direction from the first position to the second position and wherein a second end of the bar slide is configured to move in a linear direction from the first position to the second position.

* * * * *